US005419292A

United States Patent [19]

Antonov

[11] Patent Number: 5,419,292

[45] Date of Patent: May 30, 1995

[54] POSITIVE-DISPLACEMENT MACHINE WITH RECIPROCATING AND ROTATING PISTONS, PARTICULARLY FOUR-STROKE ENGINE

[76] Inventor: Roumen Antonov, 25 rue d'Artois, Paris 75008, France

[21] Appl. No.: 290,854

[22] PCT Filed: Feb. 18, 1993

[86] PCT No.: PCT/FR93/00162

§ 371 Date: Aug. 2, 1994

§ 102(e) Date: Aug. 15, 1994

[87] PCT Pub. No.: WO93/17224

PCT Pub. Date: Sep. 19, 1993

[30] Foreign Application Priority Data

Feb. 21, 1992 [FR] France ..... 92 02023

[51] Int. Cl.[6] ..... F02B 53/00

[52] U.S. Cl. ..... 123/241; 418/54; 418/160; 418/270

[58] Field of Search ..... 123/18 R, 43 R, 241; 418/54, 58, 160, 270

[56] References Cited

U.S. PATENT DOCUMENTS

| | | | |
|---|---|---|---|
| 3,315,653 | 4/1967 | Chicurel | 418/160 |
| 3,574,494 | 4/1971 | Bellmer | 418/270 |
| 5,004,409 | 4/1991 | Nakhmanson | 418/160 |

FOREIGN PATENT DOCUMENTS

| | | | |
|---|---|---|---|
| 1379609 | 10/1964 | France | 418/54 |
| 2651019 | 2/1991 | France . | |
| 3634899 | 6/1987 | Germany | 123/241 |
| 166077 | 7/1921 | United Kingdom | 123/241 |

*Primary Examiner*—Michael Koczo

*Attorney, Agent, or Firm*—Bierman and Muserlian

[57] ABSTRACT

Four elements (9a, 9b, 11a, 11b) are mutually articulated as a parallelogram deformable according to four parallel axes (A1, . . . A4). A crank (31) causes a circular motion of a first co-ordination axis (K1) connected to one (9a) of the elements. Another element (11b) is articulated to the frame along a second co-ordination axis (K2). A variable volume chamber (17) is defined between the cylindrical surfaces (S1, . . . S4) whose axes (C1, . . . C4) intersect the longitudinal axes (Da, Db) of the first elements (9a, 9b). Distribution orifices (19, 21) are selectively open and obturated by the elements as a function of the angular position of the crank (31). A sparking-plug is provided. Each first element (9a, 9b) carries two cylindrical convex surfaces (S1, S2; S3, S4) the rigidely interconnected. Each cylindrical surface is in dynamic sealing relationship with a cylindrical surface belonging to the other element and whose axis (C1, . . . C4) instersects a same line (L14, L23) parallel to the longitudinal directions (Ea, Eb) of the second elements (11a, 11b). Utilization for easily constructing a rapid machine of the type four-stroke one-cycle per revolution and low relative speed of the dynamic sealing lines.

43 Claims, 11 Drawing Sheets

FIG_1
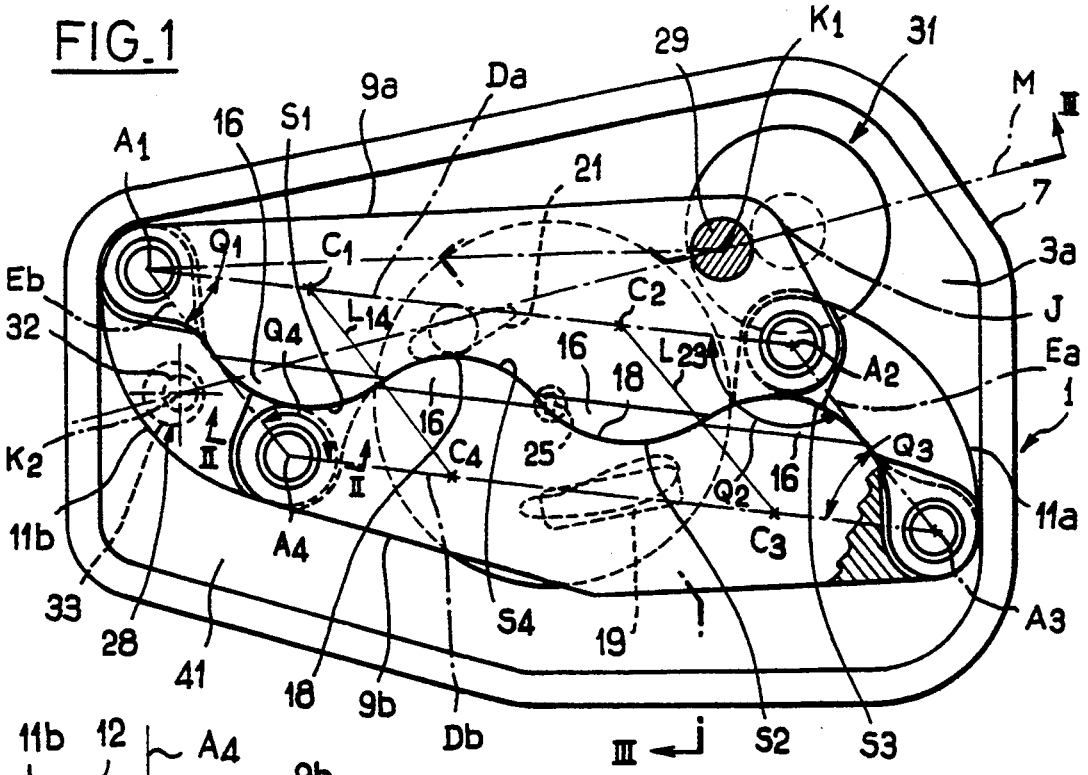
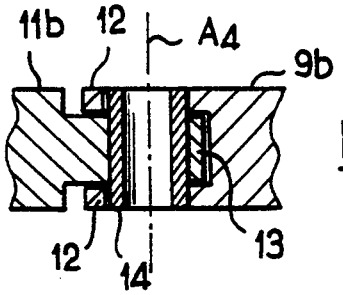
FIG_2
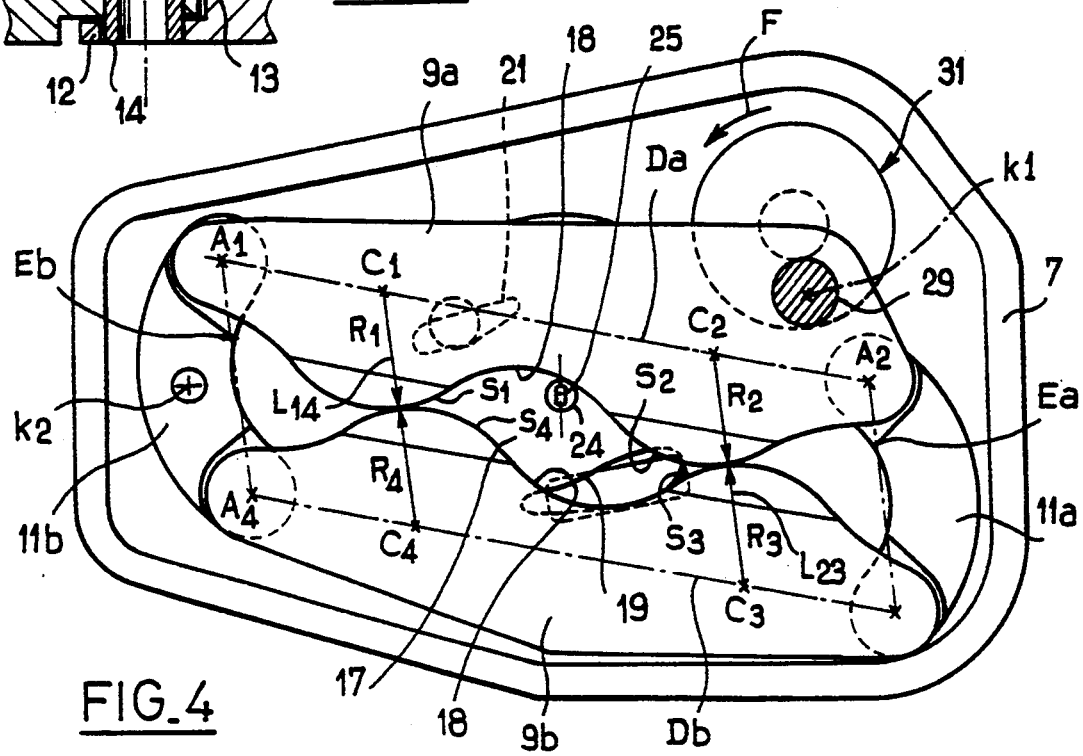
FIG_4

FIG. 5
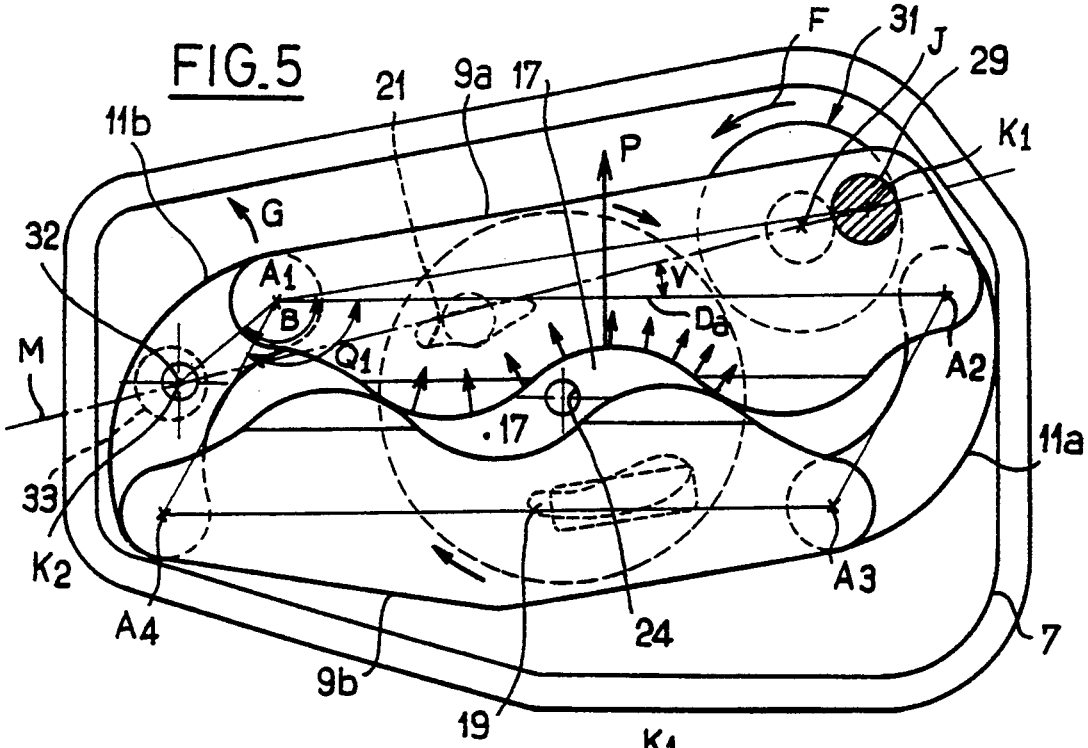
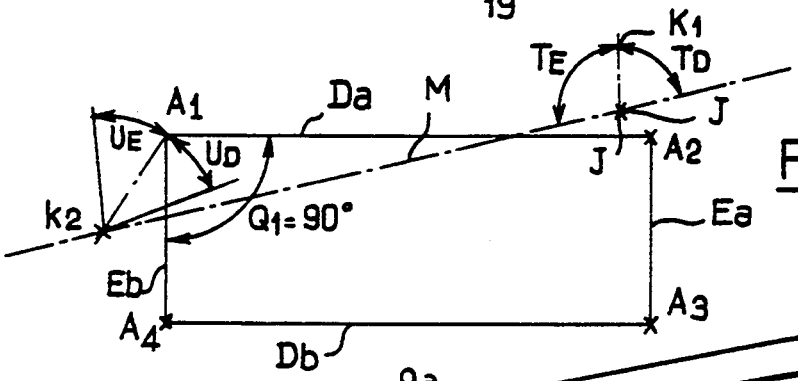
FIG. 6
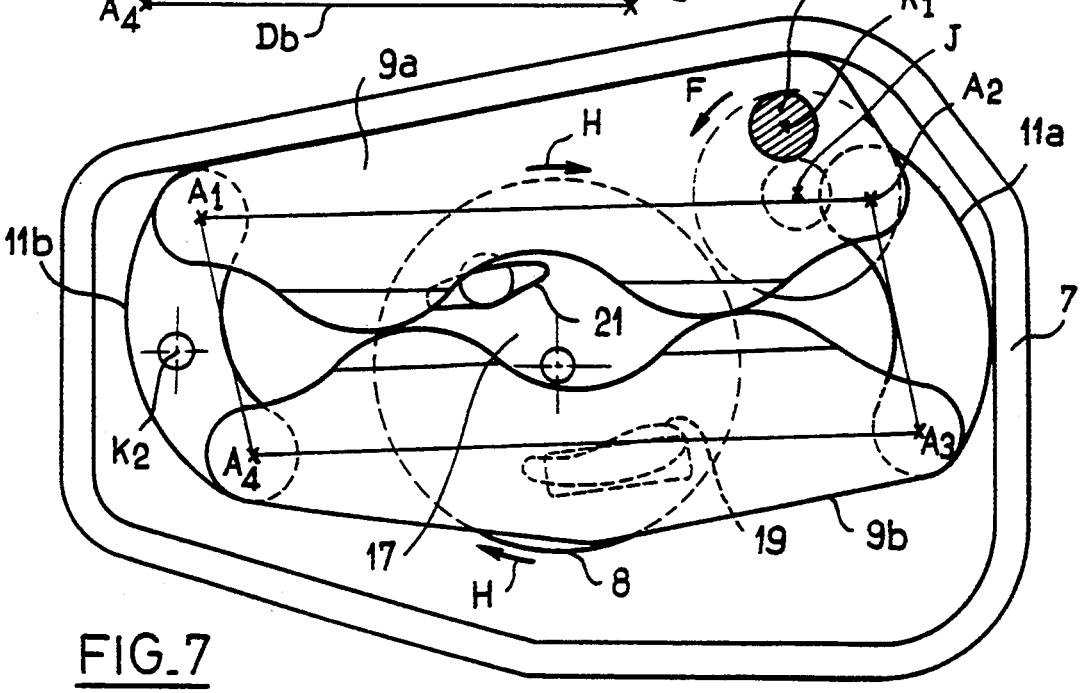
FIG. 7

FIG_10
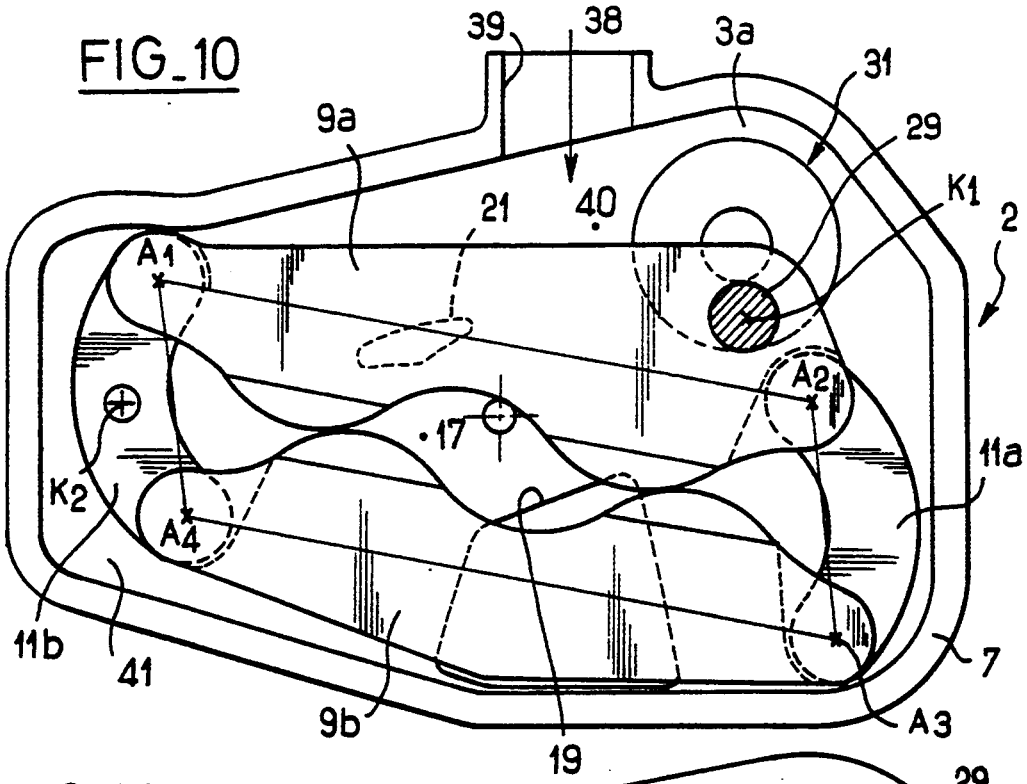
FIG_14
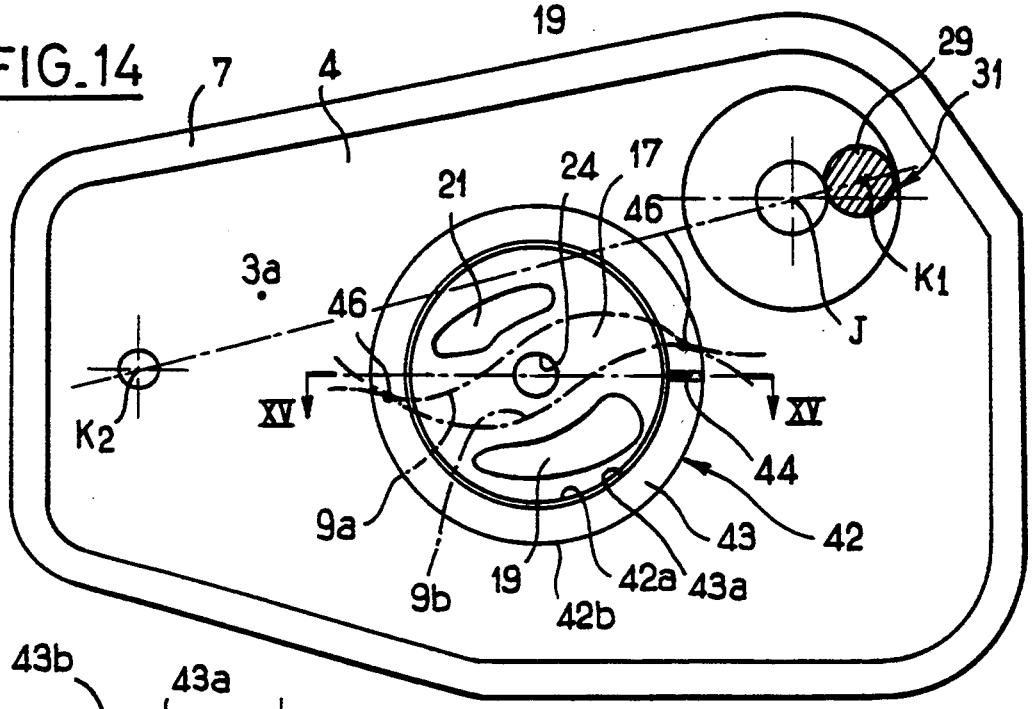
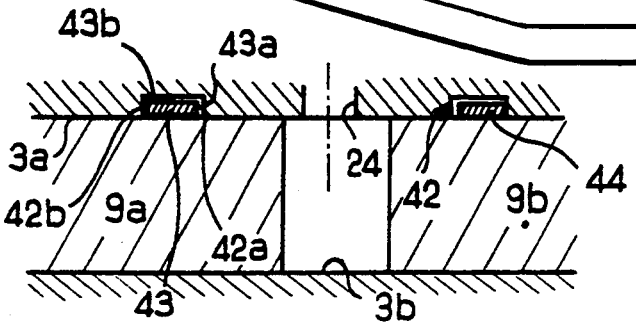
FIG_15

POSITIVE-DISPLACEMENT MACHINE WITH RECIPROCATING AND ROTATING PISTONS, PARTICULARLY FOUR-STROKE ENGINE

The present invention concerns a positive-displacement machine in which reciprocating and rotating pistons define between them a variable volume-chamber.

The FR-A-2 651 019 describes a positive-displacement machine comprising four elements connected as a deformable parallelogram. Each element comprises a convex cylindrical surface and a concave cylindrical surface, each centered on one of the articulation axes of the element and co-operating in a sealed manner with the concave cylindrical surface of one of the neighbouring elements and with the convex cylindrical surface of the other neighbouring element respectively. One of the articulation axes of the parallelogram is fixed, and the opposite axis is driven in a circular motion. This simultaneously causes a variation in the angles at the apex of the parallelogram and an oscillation of the parallelogram around its fixed axis. The variation in the angles of the parallelogram causes the volume of a chamber defined between the four convex cylindrical surfaces to vary. The oscillation around the fixed axis enables this chamber to communicate selectively with an inlet port and an exhaust port. A thermal engine is thus created which performs the four strokes (inlet, compression, explosion, exhaust) in a single revolution of a crank.

This machine has the drawback of being relatively big for a given displacement capacity, and of failing to enable very high compression ratios.

The construction of each element requires considerable precision for a high-quality seal to be achieved without mechanical friction becoming prohibitive.

The object of this invention is to offer a positive-displacement machine which overcomes these drawbacks.

The invention is thus directed to a positive-displacement machine comprising, between two flat, parallel faces facing one another, two first opposing elements articulated to two second opposing elements around four articulation axes perpendicular to the said faces and arranged at the four apexes of a parallelogram each side of which constitutes the longitudinal axis of a respective one of the first and second elements, the elements supporting four convex cylindrical walls which between them define a variable-volume chamber, the longitudinal axis of each first element being intersected by the axes of two respective convex cylindrical walls, two lines running in the same direction as the axes of the second elements each being intersected by the axes of two respective convex cylindrical walls, the machine also comprising means of co-ordination connected to two of the elements along two co-ordination axes, the means of co-ordination comprising a crank type system connected to a drive shaft and to one of these two elements to make the parallelogram oscillate between the flat faces and at the same time cause its angles at the apexes and consequently the volume of the chamber to vary, distribution ports being located on one at least of the opposing flat faces to cause the chamber to communicate selectively with an inlet and exhaust depending on the angular position of the crank.

According to the invention, the machine is characterised in that each first element rigidly supports the two convex cylindrical walls whose axes intersect the longitudinal axis of the said first element, in that each convex cylindrical wall forms with the convex cylindrical wall intersecting the same line a pair of cylindrical walls belonging to different first elements, in that each first element has closure means extending between its two convex cylindrical walls, and in that the machine comprises means of dynamic sealing between the convex cylindrical walls of a same pair.

The main function of the second elements is to maintain a constant distance between the centers of the convex cylindrical walls of the same pair.

In other words, everything occurs as if a deformable parallelogram would connect the four axes of the four convex cylindrical walls. Thus the distance between the convex cylindrical walls of the same pair is always the same, whatever the configuration of the deformable parallelogram. This makes it possible to provide dynamic means of sealing, between the convex cylindrical walls of the same pair, even though such walls can move in relation to each other. The convex cylindrical walls of different pairs and which are adjacent to each other around the periphery of the parallelogram are fixed in relation to each other since they are supported by the same first element, and it is therefore easy to achieve a sealed connection between them using the means of sealing closure, which may be of a static type.

Between the four convex cylindrical walls a chamber is thus defined whose periphery is closed in an essentially sealed manner and whose volume varies depending on the configuration of the parallelogram.

Preferably, the positive-displacement machine according to the invention is designed to operate as a four-stroke thermal engine, and in particular comprises means to initiate combustion positioned to correspond with the chamber at least when the latter is in a first minimal-volume position.

The machine according to the invention, like the above-discussed prior art machine, performs the four strokes in a single turn of a crank. But its size is reduced and there are only two dynamic seals around the chamber, between the convex cylindrical walls of the same pair. Furthermore, these seals can be reduced to a single tangential contact between convex cylindrical walls, which is a particularly simple solution and extremely reliable even at very high speeds. In particular, this type of proximity relation is not apt to cause seizing. Furthermore, the relative speed between the convex cylindrical walls of the same pair is particularly low, for a given speed of rotation of the crank.

It is also possible to interpose between the convex cylindrical walls of the same pair a sealing element such as a generally biconcave-shaped floating bar, or even a sealing body fixed to a second element articulated to the first elements around two articulation axes corresponding with the axes of the cylindrical walls of the pair in question.

Other details and advantages of the invention will emerge more clearly from the following description, relating to examples which are in no way restrictive.

In the attached drawings:

FIG. 1 is a view of an elemental machine according to the invention, along I—I of FIG. 3;

FIG. 2 is a partial sectional view along II—II of FIG. 1;

FIGS. 4, 5 and 7 are similar views to FIG. 1, but showing the machine at three successive stages of its operation;

FIG. 6 is a diagrammatic view showing one of the chamber's maximum-volume positions;

FIG. 10 is a similar view to FIG. 4 but corresponding to a modified embodiment;

FIG. 14 is a schematic view of the inner face of a head 4 according to a third modified embodiment;

FIG. 15 is a partial sectional view of the machine along line XV—XV of FIG. 14;

Figure 3:
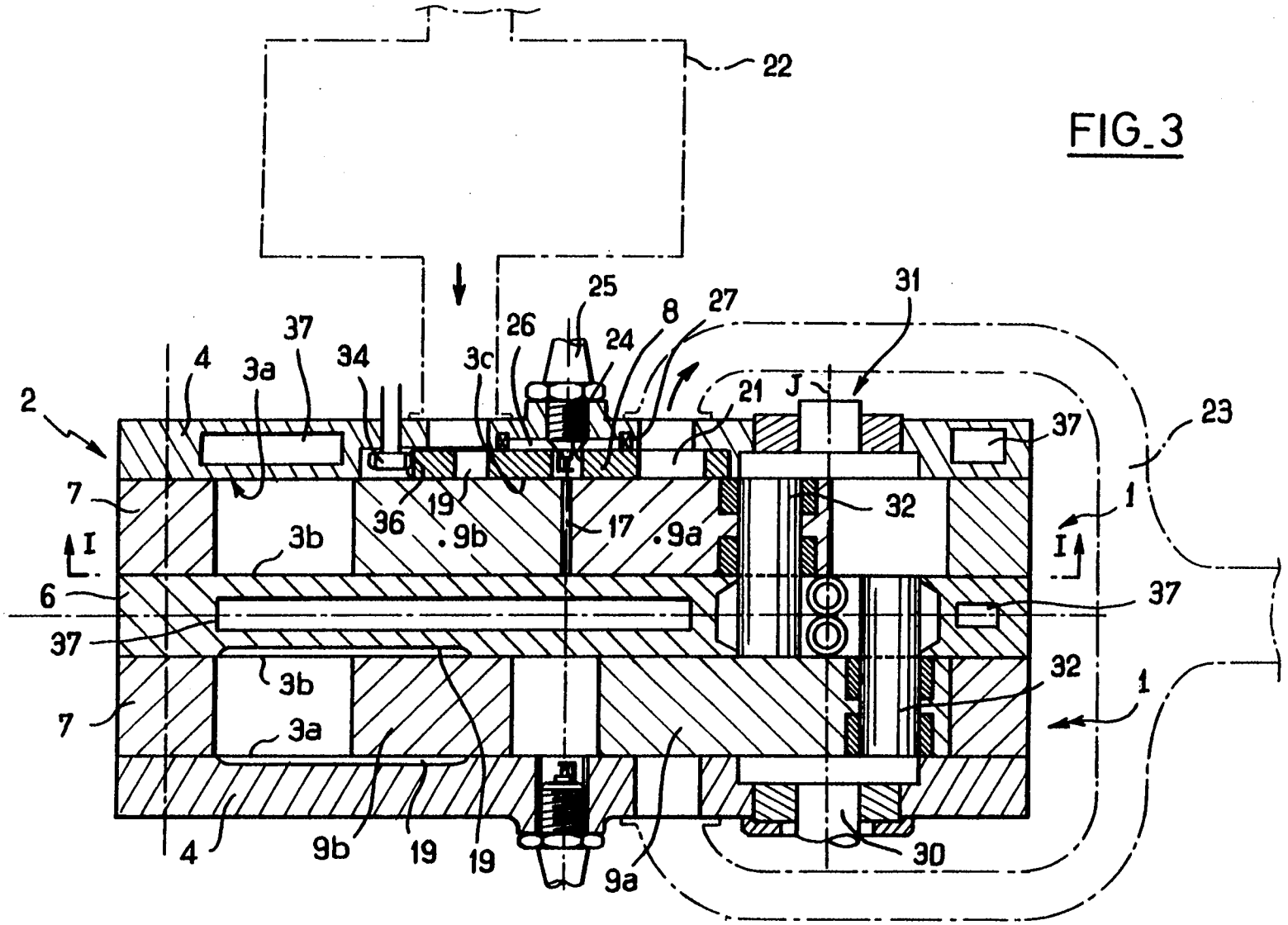
FIG. 3 is a sectional view of the machine along line III—III of FIG. 1.

We shall now describe with reference to FIGS. 1 and 2, and also to the top of FIG. 3, a first example of the elemental machine according to the invention.

An actual machine may comprise a single elemental machine or several elemental machines, for example two elemental machines 1 as shown in FIG. 3, where the elemental machine at the bottom corresponds to a modified embodiment which shall be described in detail later.

As shown at the top of FIG. 3, the machine comprises a housing 2 which defines for each elemental machine two flat parallel faces 3*a* and 3*b* facing each other. Flat faces 3*a* are defined at least in part by two opposing heads of housing 2, whereas the two faces 3*b* are formed by two opposing faces of an intermediate partition 6 located at an equal distance between the two faces 3*a*. The distance between each head 4 and intermediate partition 6 is defined by a respective peripheral wall 7.

A part 3*c* of flat face 3*a* of the elemental machine at the top of FIG. 3 is defined by a turret 8, in the form of a plate, which is mounted rotationally in a suitable recess in corresponding head 4, for reasons which will emerge later.

Heads 4, intermediate partition 6 and peripheral walls 7 together form a framework for the machine. Turret 8 is movable in relation to this framework but, as an element defining the volumes inside the machine, is deemed to belong to housing 2.

As FIG. 1 shows, each elemental machine 1 comprises, between flat faces 3*a* and 3*b*, two first opposing elements 9*a* and 9*b*, and two second opposing elements 11*a* and 11*b*.

Each first element 9*a* or 9*b* is articulated to the two second elements 11*a* and 11*b* around two separate articulation axes. There are therefore four separate articulation axes A1, A2, A3, A4 which are all parallel to each other and perpendicular to flat faces 3*a* and 3*b*.

These four axes A1, A2, A3, A4 are located at the four apexes of a parallelogram. The longitudinal axis of each element 9*a*, 9*b*, 11*a* and 11*b* means the side of the parallelogram Da, Db, Ea, Eb respectively, which joins the two articulation axes of the element in question, for example the articulation axes A1 and A2 for the first element 9*a* having the longitudinal axis Da.

FIG. 2 shows the structure of the articulation of axis A4 between elements 9*b* and 11*b*. The end of first element 9*b* has two parallel ears 12, forming a fork, between which a single ear 13 of second element 11*b* is engaged. A tubular pin 14 is fitted through the two ears 12 and ear 13 to achieve the articulated connection.

Each first element 9*a* or 9*b* has, on its side turned towards the other first element, two convex cylindrical walls S1, S2 and S3, S4 respectively defined by inserted linings 16.

Axis C1, C2, C3 or C4 of each cylindrical wall S1, S2, S3 or S4 intersects longitudinal axis Da or Db of the first element 9*a* or 9*b* with which the cylindrical wall is integral.

Furthermore, each cylindrical wall S1–S4, forms with a cylindrical wall of the other first element, a pair of cylindrical walls whose axes intersect the same line L14 or L23 parallel to longitudinal axes Ea and Eb of the second elements 11*a* and 11*b*. Thus, cylindrical walls S1 and S4 together form a pair whose axes C1 and C4 intersect the same line L14 parallel to axes Ea and Eb, and similarly, walls S2 and S3 form a pair whose axes C2 and C3 intersect the same line L23 parallel to longitudinal axes Ea and Eb.

It will therefore appear that axes C1, C2, C3, C4 are at the four apexes of a second parallelogram whose sides C1C2 and C3C4 are always indistinguishable from longitudinal axes Da and Db of the first elements 9*a* and 9*b* and whose sides C1C4 and C2C3 (Lines L14 and L23) are always parallel to axes Ea and Eb.

In the example, axes C1 and C2 are located between axes A1 and A2 of the corresponding first element 9*a*, and axes C3 and C4 are located between axes A3 and A4 of the first corresponding element 9*b*. This is an advantageous practical arrangement with all the cylindrical walls S1–S4 being located between the second elements 11*a* and 11*b*.

In the example shown, each second element 11*a*, 11*b* has a curved shape which is concave towards the inside of the parallelogram in order, particularly in the extreme position shown in FIG. 1, to marry up with the contour of cylindrical wall S1 or S3 respectively which is then closest. Size is thus reduced to a minimum. This also applies to walls S2 and S4 in another extreme position shown in FIG. 5.

The four elements 9*a*, 9*b*, 11*a*, 11*b* can move in relation to each other, starting from the extreme position shown in FIG. 1 and may thus assume different attitudes, some of which are shown in FIGS. 4, 5, 6 (schematically) and 7.

In the situation shown in FIG. 4, a chamber 17 has formed between the two first elements 9*a* and 9*b*. Chamber 17 is delimited by that part of each cylindrical wall S1–S4 which is located inside parallelogram C1, C2, C3, C4, as well as by closure means formed by two concave cylindrical surfaces 18 each rigidly supported by one of the first elements 9*a* and 9*b* and connecting the two convex cylindrical walls S1 and S2 or S3 and S4 respectively of the first element in question. Each concave cylindrical surface is complementary to each of the convex cylindrical walls of the other first element. Thus, in the attitude shown in FIG. 1, cylindrical wall S2 of first element 9*a* fits into concave surface 19 of first element 9*b*, and cylindrical wall S4 of first element 9*b* fits into concave surface 18 of first element 9*a*, which reduces the chamber to a volume which is essentially zero. The situation shown in FIG. 1 corresponds to the end of explosion or start of inlet. Reducing the volume of the chamber to zero at this stage of the cycle makes it possible to evacuate the exhaust gases completely and to separate the latter perfectly from the gases which will just be admitted for the next engine cycle.

Returning to FIG. 4, chamber 17 is also closed by dynamic sealing means. In the example these dynamic sealing means consist in a selected dimension: radii R1, R2, R3, R4 of convex cylindrical walls S1–4 are selected so that the sum of the cylindrical wall radii of the same pair is equal to the distance between the axes of the cylindrical surfaces of the same pair.

In the example, radii R1–R4 are equal to each other and equal to half the distance between axes C1 and C4 or between axes C2 and C3. Thus the cylindrical walls of the same pair, S1 and S4 or S2 and S3, are permanently in tangential proximity which ensures an essentially sealed closure of chamber 17.

Furthermore, chamber 17 is closed by flat parallel faces 3*a* and 3*b* (FIG. 3), except in certain attitudes (FIGS. 4 and 6) where chamber 17 communicates with an inlet port 19 (FIG. 4) or with an exhaust port 21 (FIG. 6). The inlet 19 and exhaust 21 ports are made through rotary turret 8. They cause chamber 17 to communicate selectively with an inlet 22, such as a carburetor and an exhaust 23 respectively.

Turret 8 has a central hole 24 into which the electrodes of spark-plug 25 screwed into head 4 project. Central hole 24 also causes chamber 17 to communicate with a back-pressure space 26 which is between a back face of turret 8 and head 4. A gasket 27 peripherally delimits back-pressure space 26 and separates it from inlet 19 and exhaust 21 ports located radially outside. The periphery of rotary turret 8 completely surrounds chamber 17 in all the attitudes of the four elements 9*a* and 9*b* and 11*a* and 11*b*. Thus, the clearance around turret 8 can never be a leakage line for chamber 17. The pressure in chamber 17, particularly when the former is high, creates in back-pressure space 26 a back-pressure which pushes turret 8 against first elements 9*a*, 9*b* and presses them against flat face 3*b*. A sufficiently sealed contact is thus ensured between elements 9*a*, 9*b* and each of flat faces 3*a* and 3*b* all around chamber 17 whatever its configuration. In order for the back-pressure in space 26 to generate a pressing force greater than the pressure in chamber 17, the area delimited by gasket 27 around hole 24 simply needs to be greater than the greatest area that chamber 17 can have when the latter is under pressure, i.e. essentially during the compression and explosion strokes.

As previously stated, the situation shown in FIG. 1 is minimum-volume situation corresponding to the end of exhaust and start of inlet.

In the situation shown in FIG. 4, chamber 17 has become bigger over inlet port 19. Consequently, the chamber has taken in fresh gas.

In the situation shown in FIG. 5 corresponding to the end of compression and start of combustion, we are again in a minimum-volume situation in which chamber 17 is isolated from inlet 19 and exhaust 21 ports and communicates with central hole 24 which accomodates the spark-plug electrodes. We can see that in this minimum-volume situation angles Q1 and Q3 of the parallelogram adjacent to axes A1 and A3, which were acute in the end of exhaust situation (FIG. 1) have become obtuse in the start of combustion situation (FIG. 5), and conversely as regards angles Q2 and Q4 adjacent to axes A2 and A4.

Chamber 17 then enlarges again (FIG. 6) to perform an engine stroke or gas explosion stroke, then communicates with exhaust port 21 until its volume becomes zero again as shown in FIG. 1.

We can see that the situations in FIG. 4 (inlet) and FIG. 5 (explosion) correspond to essentially identical attitudes of the four elements 9*a*, 9*b*, 11*a* and 11*b* in relation to each other. The fact that chamber 17 communicates with inlet port 19 in the situation shown in FIG. 4 and with exhaust port 21 in the situation shown in FIG. 5 is due to the fact that the four-element assembly 9*a*, 9*b*, 11*a*, 11*b* is not in the same place in the space defined by the inner peripheral face of peripheral wall 7. The movements of elements 9*a*, 9*b*, 11*a*, 11*b* in relation to each other as well as the movements of the assembly that they form inside peripheral wall 7 are defined by co-ordination means which cause the position of a first co-ordination axis K1, integral with first element 9*a*, to vary in relation to a second co-ordination axis K2 integral with second element 11*b*. Second co-ordination axis K2 is the axis of a pivoting connection 28 which connects element 11*b* to the machine's framework. Co-ordination axis K2 is located at an equal distance from articulation axes A1 and A4 of second element 11*b* and outside parallelogram A1, A2, A3, A4.

Co-ordination axis K1 is the articulation axis between element 9*a* and an eccentric trunnion 29 of a crank 31 pivoting around an axis J in relation to the machine's framework. Co-ordination axis K1 is close to articulation axis A2 by which first element 9*a* is articulated to that second element 11*a* which is not connected to co-ordination axis K2. Axes of co-ordination K1 and K2 are perpendicular to faces 3*a* and 3*b* and consequently parallel to the other axes A1–A4, C1–C4.

Considering Line M (FIG. 1) passing through rotation axis J of crank 31 and co-ordination axis K2, the two minimum-volume positions of chamber 17, which correspond to the extreme values for the angles of the parallelogram, are obtained when the first co-ordination axis K1 is located on Line M, between axes K2 and J in FIG. 1, or beyond axis J in FIG. 5. In effect, it is in this position that the distance between axes K1 and K2 is the shortest and greatest respectively, and consequently angle Q1 is the smallest and largest respectively.

The radius of gyration of co-ordination axis K1, i.e. the distance between axes J and K1, is smaller than the distance between co-ordination axis K2 and articulation axis A1 between the two elements 9*a* and 11*b* connected to co-ordination axes K1 and K2. Thus, the rotations of crank 31 produce to and fro angular movements of second element 11*b* around pivoting connection 28.

The crank is designed so that the position of co-ordination axis K1, in the first minimum-volume position (FIG. 5), corresponding to the start of combustion, is such that the volume of chamber 17 in this position is not zero but by contrast corresponds to the compression ratio that we wish to give to the machine, and so that the position of co-ordination axis K1 in the second minimum-volume position or end of exhaust position, shown in FIG. 1 is such that the volume of chamber 17 is zero in this position. If we assume that the position of co-ordination axis K2 is defined, the direction of Line M passing through co-ordination axis K2 and the position of axis K1 being on first element *9a*, the two above-mentioned conditions give the two positions of axis K1 on Line M to achieve the two minimum-volume positions of chamber 17 and consequently give the position of axis J located on Line M as being half way between the two positions of K1.

In neither of the two minimum-volume positions (FIGS. 1 and 5), is articulation axis A1 between the two elements *9a* and *11b* connected to means of co-ordination 28/31, located on Line M. Thus, in these positions the direction of pivoting of second element *11b* around co-ordination axis K2 necessarily changes. If axes A1 and K1 were both to pass onto Line M there would be indetermination as regards the direction of rotation of second element *11b* from this position.

However, in the first minimum-volume position (FIG. 5) corresponding to the start of combustion, axis A1 is not far from Line M. Angle B which separates axes K1 and K2 seen from axis A1 is therefore almost 180°. Furthermore, the directions of rotation F and G of crank 31 and element *11b* respectively from this minimum-volume position are the same. Taking these conditions into account, a relatively small angular displacement of crank 31 produces on second element *11b* a relatively large angular displacement, more than proportional to the ratio of the gyration radii of axes K1 and A1. Moreover, as axes K1 and K2 are both located outside the parallelogram, angle B is much greater than corresponding angle Q1, which is almost 120° in the example. Thus the angular travel to be made by element *11b* for the parallelogram to pass from the first minimum-volume position (FIG. 5) to the subsequent maximum-volume position (FIG. 6) in which the parallelogram is a rectangle is about 30° and therefore relatively small. For two cumulative reasons, crank 31 therefore need make only a relatively short angular travel for element *11b* to perform a rotation of about 30° around axis K2 which is necessary for parallelogram A1, A2, A3, A4 to become a rectangle and consequently chamber 17 to achieve its maximum volume.

In the example shown, crank 31 need only make a rotation TD (FIG. 6) of about 75° for elements *9a*, *9b*, *11a*, *11b* to pass from the first minimum-volume position (FIG. 5) to the following maximum-volume position in which parallelogram A1, A2, A3, A4 is a rectangle.

We can also see that in the situation in FIG. 7 corresponding to a rotation of 90° of crank 31 starting from the first minimum-volume position, the rectangular configuration of parallelogram A1, A2, A3, A4 is clearly exceeded, i.e. angle Q1 is already reduced to a value of about 75°.

This is advantageous because explosion of the gases may occur very quickly, for a given speed of rotation of the crank, and this minimises the time during which the heat is dissipated through the metal walls, and consequently minimises heat loss.

The amplitude of the oscillating movement of second element *11b* is only about 90° between the two minimum-volume positions of chamber 17 shown in FIGS. 1 and 5. This is obtained by giving the gyration radius of articulation axis A1 around second co-ordination axis K2 a sufficiently long length as compared to the gyration radius of co-ordination axis K1 around axis J of crank 31.

FIG. 6 shows the maximum-volume situation of the chamber at the end of explosion, showing angle TD which was travelled through by co-ordination axis K1 since the first minimum-volume position (start of combustion), and angle TE, of about 105° which remains to be travelled until the second minimum-volume position, as well as the two angles UD and UE covered by articulation axis A1 around co-ordination axis K2. Due to the geometry selected, the two angles TD and TE, very different from each other, produce for axis A1 two essentially equal angles of displacement UD and UE respectively.

In the first minimum volume position (FIG. 5) the pressure of the gases acting on element *9a* has a resultant P which acts on trunnion 29 of crank 31 in a direction which is essentially tangential in relation to the circular trajectory of axis K1 of trunnion 29, and which is in the direction of rotation F of crank 31. This resultant is therefore very effective for transmitting torque to crank 31 without producing parasitic stress in the mechanism. This is due to the small value of angle V between longitudinal axis Da of element *9a*, a direction to which resultant P is essentially perpendicular, and Line M which corresponds in this position to the direction of the lever arm of crank 31. Another cause of the favourable application of the force of the gases on crank 31 is the suitable direction chosen for the rotation of crank 31. If a direction of rotation had been chosen for crank 31 which was opposite to direction F, operation would also have been possible since starting from the position in FIG. 5, chamber 17 would increase in volume just the same to return to the situation shown in FIG. 4. But the transmission of the force to the crank would be in an extremely indirect manner by the medium of first element *9b*, and second element *11b* operating as a reverser lever pulling element *9a* towards the left in FIG. 5.

As shown in FIG. 3, crank 31 is connected to an output shaft 30 to which, in a standard manner, an inertia flywheel may be connected together with a multiple-ratio transmission device to form a power plant for a motor vehicle. In an equally standard manner, this inertia flywheel, and/or the inertial load constituted by the vehicle, provide crank 31 with the energy required to maintain operation during the energy consumption stages (inlet, compression, exhaust).

Crank 31 has two eccentric trunnions 32, one for each elemental machine 1, offset by 180° in relation to each other around axis J to cancel out the main constituents of the inertia of each elemental machine 1. A more perfect cancellation is achieved if the two elemental machines 1 are completely offset in relation to each other by 180° around axis J so that all the movements in each elemental machine 1 are symmetrical with those in the other elemental machine 1 in relation to axis J (ignoring the axial offsetting of one machine in relation to the other along axis J).

The machine shown in FIGS. 1 to 6 has means of adjustment enabling its operation to be optimised.

In particular, pivoting connection 28 has a trunnion 32 (FIG. 1) around which second element *11b* pivots and which is supported by a cam 33 mounted rotationally in the framework. When, as shown in FIG. 1, cam 33 is positioned so that trunnion 32 is as close as possible to axis J of crank 31, angle B and consequently angle Q1 are as small as possible in the first minimum-volume position of chamber 17 (FIG. 5). Consequently, the volume of cheer 17 in the first minimum-volume position is as large as possible, which corresponds to the minimum compression ratio for the machine, since the maximum volume of chamber 17, defined by the rectangular configuration of parallelogram A1, A2, A3, A4 (FIG. 6), is independent of the position of trunnion 32.

In the second minimum-volume position (FIG. 1), this position of trunnion 32 again corresponds to the smallest possible value for angle Q1 and consequently to the smallest possible volume for chamber 17, i.e. zero volume in the example.

Figure 8:
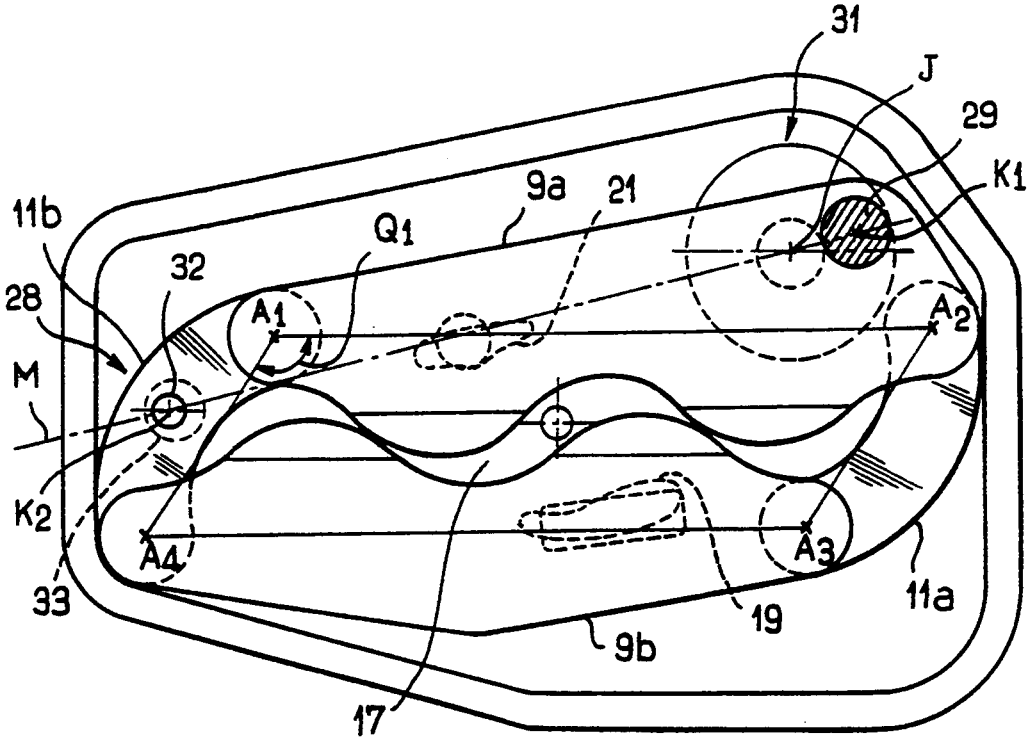
FIGS. 8 and 9 are views corresponding to FIGS. 5 and 1 respectively, but with a different compression ratio adjustment.
Figure 9:
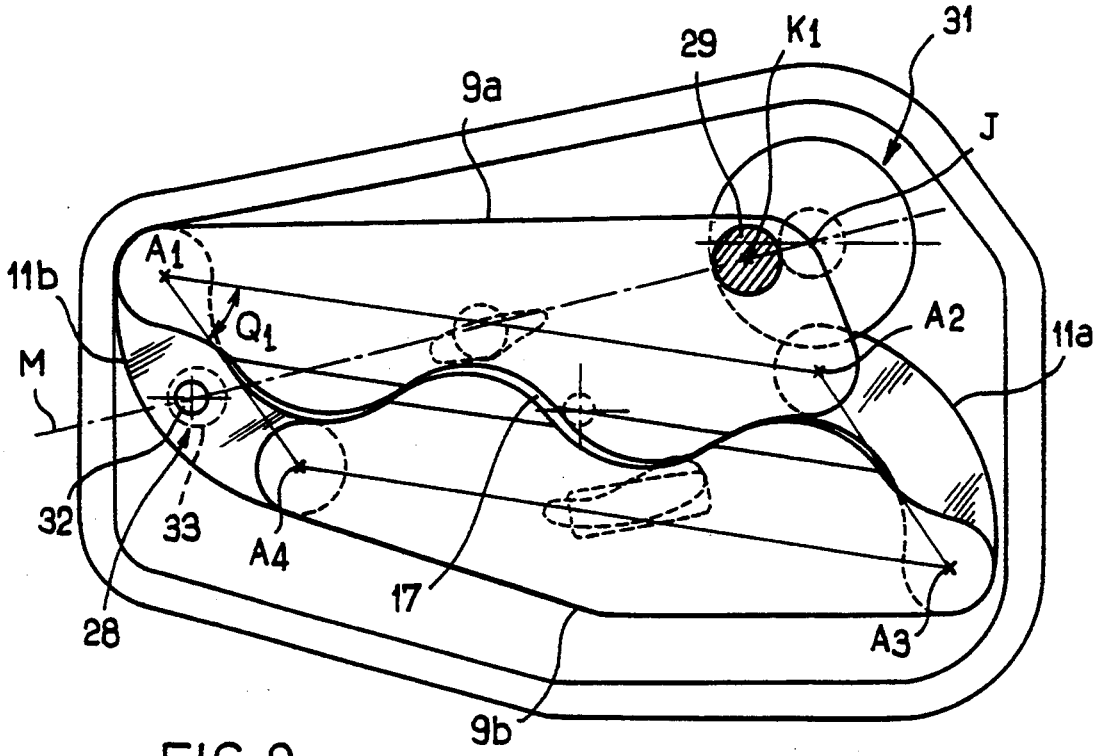

If, as shown in FIGS. 8 and 9, cam 33 has turned through 180° so that trunnion 32 is as far away as possible from axis J of crank 31, angle Q1 in the first (FIG. 8) and second (FIG. 9) minimum-volume position has increased. This corresponds to a reduction in volume of chamber 17 in the first minimum-volume position and consequently to an increase in the compression ratio of the machine and to an increase in volume of chamber 17 in a second-minimum volume position (FIG. 8). This relatively small increase may be regarded as a drawback since it gives rise to a dead volume from which the exhaust gases cannot be expelled mechanically.

Adjustment in rotation of cam 33 in order to adjust the compression ratios of the machine may be performed manually, even during running, or automatically. For example, cam 33 may be connected to a device that measures depression in inlet 22 in order to increase the compression ratio when this depression is high (low absolute pressure) and to reduce the compression ratios when the absolute pressure in inlet 22 becomes higher. Such automatic adjustment would be particularly advantageous in the case of a supercharged engine.

As we know, it is advantageous to adjust the timing of a thermal engine to suit its operating parameters, particularly the speed of rotation and the load.

This is enabled according to the invention, by rotating turret 8 around the axis of central hole 24. In the diagram of the example, this rotation is enabled by a pinion 34 engaging with teeth 36 on part of the periphery of turret 8 (FIG. 3).

FIG. 7 shows that if, from the position shown, turret 8 had been turned in the direction shown by arrows H, exhaust port 21 would have been uncovered sooner by element 9*a* and consequently chamber 17 would have communicated earlier with the exhaust. This corresponds to a position which is desirable when the engine's speed of rotation is higher. This angular offsetting also places inlet port 19 in a position in which it will begin to communicate with chamber 17 slightly before the end of the exhaust stroke, which is also desirable for high speeds, particularly if, as shown in FIG. 9, the volume of chamber 17 in the second minimum- volume position is not zero we thus achieve, in a known way, a scavenging effect on the last remaining burnt gases which are flushed towards the exhaust port by fresh gases entering through the inlet port.

The angular position of turret 8 may be controlled manually or automatically depending on the speed of rotation of crank 31 and the pressure at inlet 22. The precise adjustments to be made on the basis of these two parameters may be determined by the technician according to standard knowledge. It should be noted, however, that due to the large gas flow cross-sections enabled by the invention, advancing the opening of the ports and retarding their closure is not as great as in standard engines with pistons and cylinders.

We shall not describe in further detail the means of cooling the engine, comprising for example various cavities 37 (FIG. 3) in intermediate partition 6 and in heads 4, nor the means of lubricating the jointed couplings.

FIG. 10 and the bottom of FIG. 3 show a simplified version capable of operating without a lubrication circuit due to a fuel supply comprising a mixture of oil+-petrol+air 38 penetrating through an inlet connection 39 into a part 40 of the peripheral space located between elements 9*a*, 11*a*, 9*b*, 11*b* and the inner face of peripheral wall 7 of housing 2. Inlet port 19 comprises a blind cutaway section in face 3*a*, through which chamber 17 communicates selectively, during the inlet stroke, with another part 41 of the above-mentioned peripheral space.

Furthermore, the inner face of peripheral wall 7 is shaped so as to be almost in contact with elements 9*a*–11*b* on one side close to articulation axis A1 whose trajectory is circular around co-ordination axis K2, and on the other side close to the diametrically opposite axis A3 along part of the trajectory of the latter. As the volume of chamber 17 increases during the inlet stroke, these quasi contacts, forming a sealed barrier, separate areas 40 and 41 of the peripheral space from each other, and the volume of area 41 decreases, which compresses the inlet gases and pushes them towards chamber 17 through port 19. This gives rise to a sort of forced inlet, or even supercharging of chamber 17. We can appreciate the variation in volume of area 41 by comparing FIGS. 1 (start of inlet) and 10 (inlet in progress).

FIGS. 5 and 7 show that, during compression and explosion, area 41 again increases in volume and axis A3 moves some distance away from the inner peripheral face of peripheral wall 7, which enables area 41 to readmit gas from area 40.

According to the modified embodiment shown in FIG. 10 and at the bottom of FIG. 3, the air/petrol/oil mixture bathes the entire mechanism located in housing 2, which ensures lubrication without a separate lubrication circuit.

Figure 11:
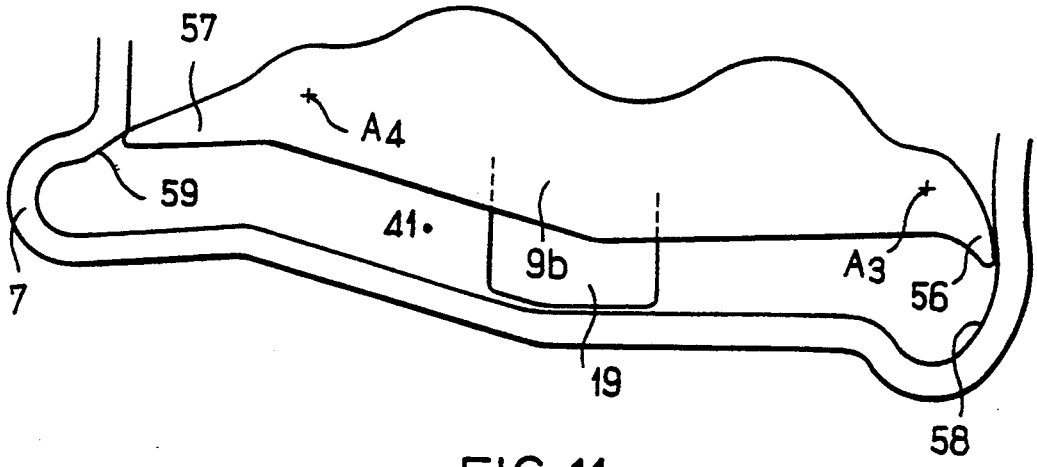
FIGS. 11 to 13 are views similar to the bottom of FIGS. 1, 10 and 5 respectively, but relating to a second modified embodiment.
Figure 12:
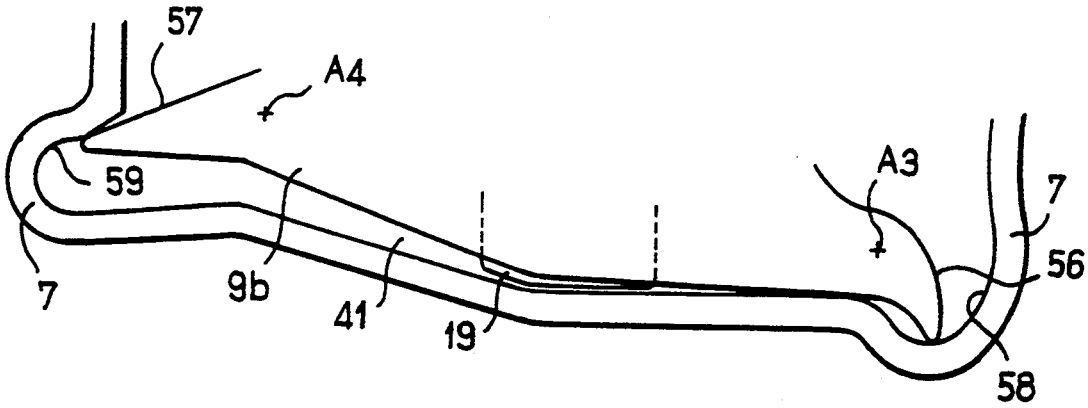
Figure 13:
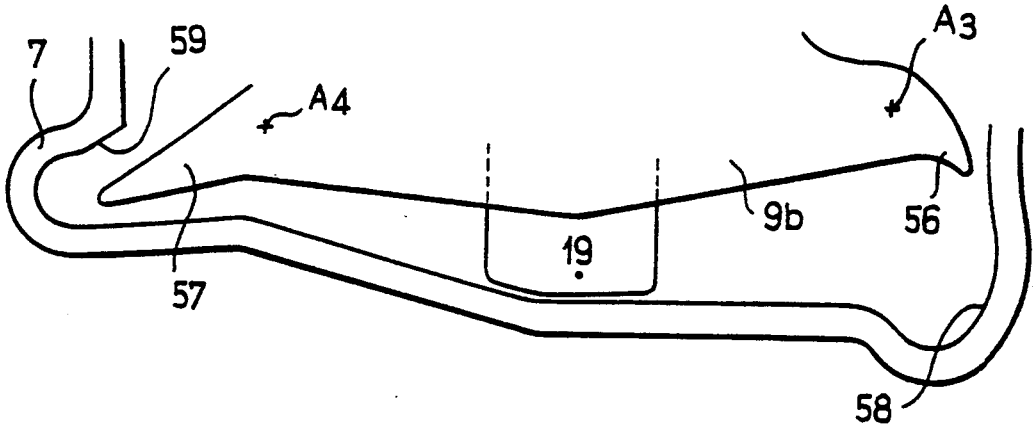

In the example shown in FIGS. 11 to 13, which will only be described as regards its differences as compared to the example shown in FIG. 10, first element 9*b* opposite that connected to the means of co-ordination (crank 31) rigidly supports two vanes 56, 57 each close to one of the articulation axes A3, A4 of the said first element. The peripheral face of inner peripheral wall 7 has two notches 58 and 59 whose profile corresponds to the envelope of the end positions of vanes 56 and 57 during the inlet stroke (FIG. 11: start of inlet, FIG. 12: end of inlet).

Moreover, during the inlet stroke, the volume of area 41 of the housing's peripheral space, located between the two vanes 56 and 57 decreases very sharply. Its reduction in volume may, for example, be 650 cm3 for an engine in which chamber 17 has a maximum volume of 400 cm3. Thus, element 9*b* forms with peripheral wall 7 of the housing a mechanical engine-supercharger compressor.

Then, during the gas explosion stroke, vanes 56 and 57 are offset by the walls of notches 58 and 59, which enables area 41 to readmit gas 38 which has entered through connection 39 (as shown in FIG. 10).

If the direction of rotation of crank 31 were reversed, the vanes would have to be placed on element 9*a* in order to create an area whose volume decreases during the inlet stroke. But this would be less advantageous since the bearings on crank 31 would have to be sealed.

In the example shown in FIGS. 14 and 15, face 3*a* is made completely on the corresponding head 4 and the inlet 19 and exhaust 21 ports can therefore no longer be adjusted around the axis of central hole 24. Face 3*a* has a circular groove 42, for example centered around the axis of hole 24. This groove is partly occupied by flat ring 43 with a radial slot 44. Ring 43 has an outer diameter which is essentially equal to the outer diameter of groove 42. Its axial thickness and radial width are smaller than the axial depth and radial width of groove 42.

Furthermore, the position of groove 42, the diameter of its radially outer edge 42*b* and the radial width of ring 43 are selected so that the lines of proximity 46 between first elements 9*a* and 9*b* are located radially between radially outer edge 42*b* of groove 42 and radially inner edge 43*a* of ring 43, at least for the positions of crank 31 for which chamber 17 must be isolated from the peripheral space surrounding the elements inside peripheral wall 7. Furthermore, elements 9*a* and 9*b* are designed, at least in the said positions of crank 31, to completely cover radially inner edge 43*a* of ring 43 except for those parts of this edge which are facing chamber 17. In other words, edge 43*a* must not be visible to an observer located in the peripheral space of the housing. Preferably, slot 44 should not appear in this space either.

Thus, the high pressure in chamber 17 penetrates into groove 42 and, on radially inner face 43*a* of ring 43, generates a thrust directed radially outwards which presses ring 43 in an essentially sealed way against radially outer edge 42*b* of groove 42, and, on back face 43*b* of ring 43 generates a thrust directed axially towards elements 9*a* and 9*b* which creates a seal between ring 43 and these elements.

Slot 44 of ring 43 enables ring 43 to increase in diameter and press against radially outer edge 42*b* under the pressure of the gases acting on its radially inner face 43*a*.

Since lines of proximity 46 between elements 9*a* and 9*b* are always facing ring 43, ring 43 prevents the gases of chamber 17 from passing behind lines of proximity 46, and then into the peripheral space, escaping along face 3*a*.

Furthermore, the axial thrust on ring 43 is transmitted by ring 43 to elements 9*a* and 9*b* and presses the latter against face 3*b* which creates a contact seal between face 3*b* and elements 9*a* and 9*b*. This prevents the gases from escaping from chamber 17 towards the peripheral space along face 3*b*.

An elastic element such as a corrugated washer or the like, may be placed between back face 43*b* of ring 43 and the bottom of groove 42 to achieve the initial pressure between ring 43 and elements 9*a* and 9*b*, and consequently to prevent the gas from pressing ring 43 against the bottom of groove 42 instead of pressing it against elements 9*a* and 9*b*. The total area of back face 43*b* of ring 43 is sufficiently large for the axial force generated by the gas on ring 43 to be sufficient.

Figure 16:
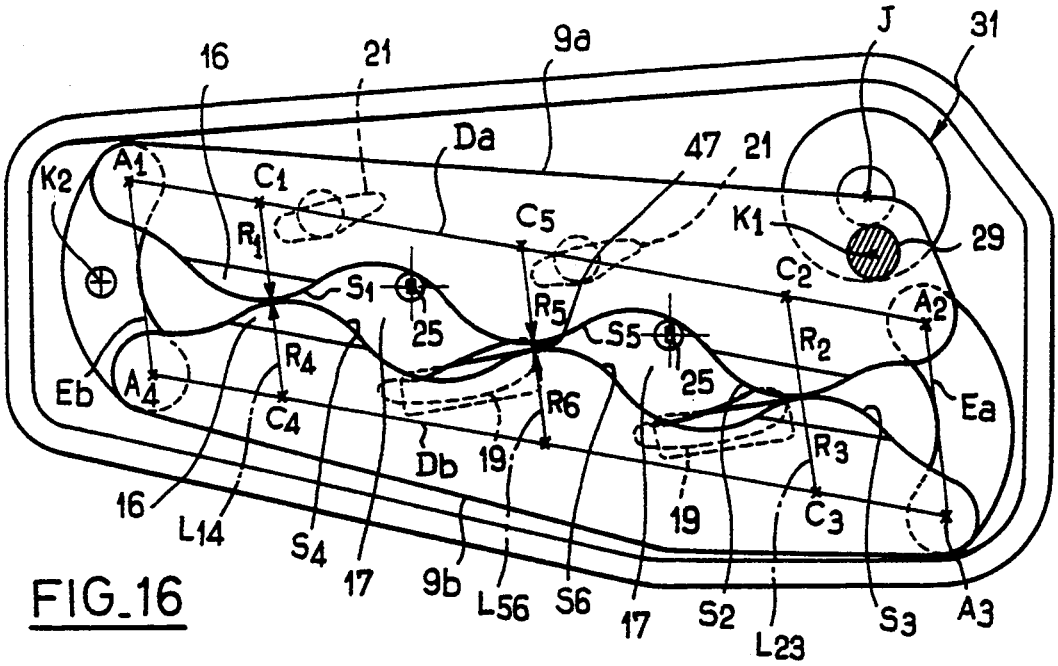
FIG. 16 is a view similar to FIG. 4 but concerning a fourth modified embodiment.

The example shown in FIG. 16 shall only be described as regards its differences as compared to that shown in FIGS. 1 to 9.

First elements 9*a* and 9*b* are lengthened and offer each other three convex cylindrical surfaces S1, S2, S5 and S3, S4 and S6 respectively. Axes C5 and C6 of surfaces S5 and S6 intersect the same line L56 located at an equal distance between lines L14 and L23 and parallel to the latter. Surfaces S5 and S6 thus form a pair of convex cylindrical walls which is located between pair S1, S4 and pair S2, S3 previously described.

Radius R5 and R6 of surfaces S5 and S6 is slightly smaller than radii R1–R4, all of which are equal, of surfaces S1–S4. There is thus a slight clearance 47 between surfaces S5 and S6. This clearance presents no problem since the two chambers 17 defined between elements 9*a* and 9*b* on either side of clearance 47 are always at the same pressure and at the same stage of the cycle of operation in all the angular positions of crank 31. Surfaces S5 and S6 can therefore be made without special finishing and in particular do not need to be made on inserts 16 such as those on surfaces S1–S4.

It is thus possible to create very simply a machine of reduced size whose displacement capacity is double that of the one shown in FIGS. 1 to 9.

Since the amplitude of the movements of chamber 17 closest to co-ordination axis K2 is smaller than that of the other chamber 17 located on the right-hand side in FIG. 16, the inlet and exhaust ports may be shaped and arranged slightly differently for each chamber (this is not shown).

Figure 17:
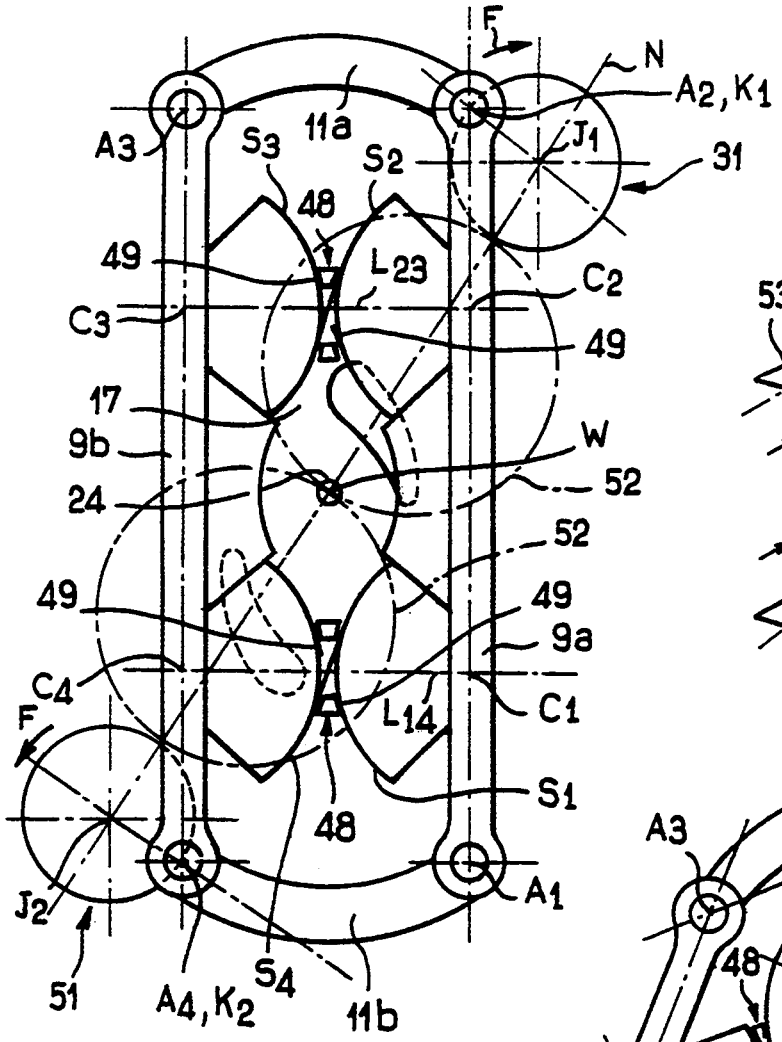
FIGS. 17 and 18 are two schematic views of a fifth modified embodiment of the invention in a maximum-volume position and minimum-volume position respectively.
Figure 19:
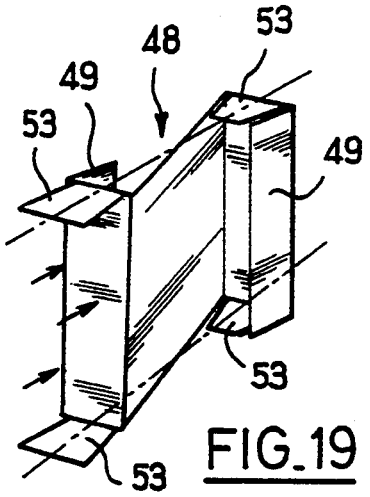
FIG. 19 is a perspective view of a sealing body for the machine in FIGS. 17 and 18.
Figure 18:
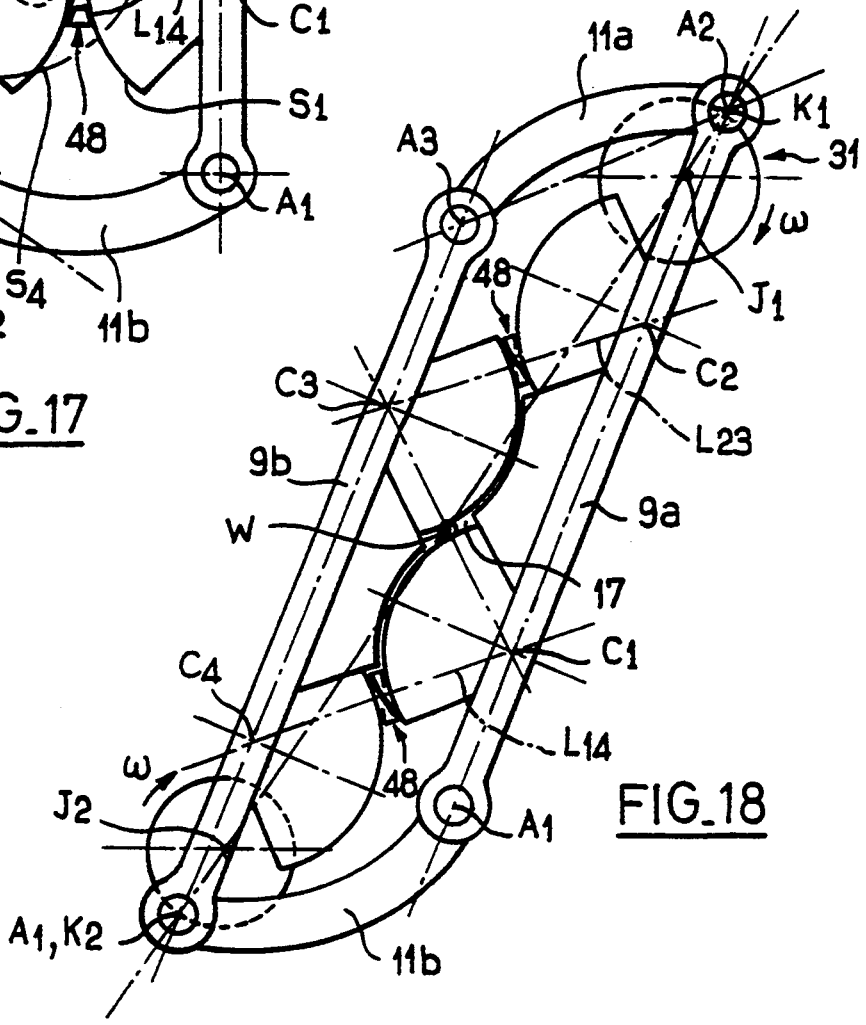
Figure 21:
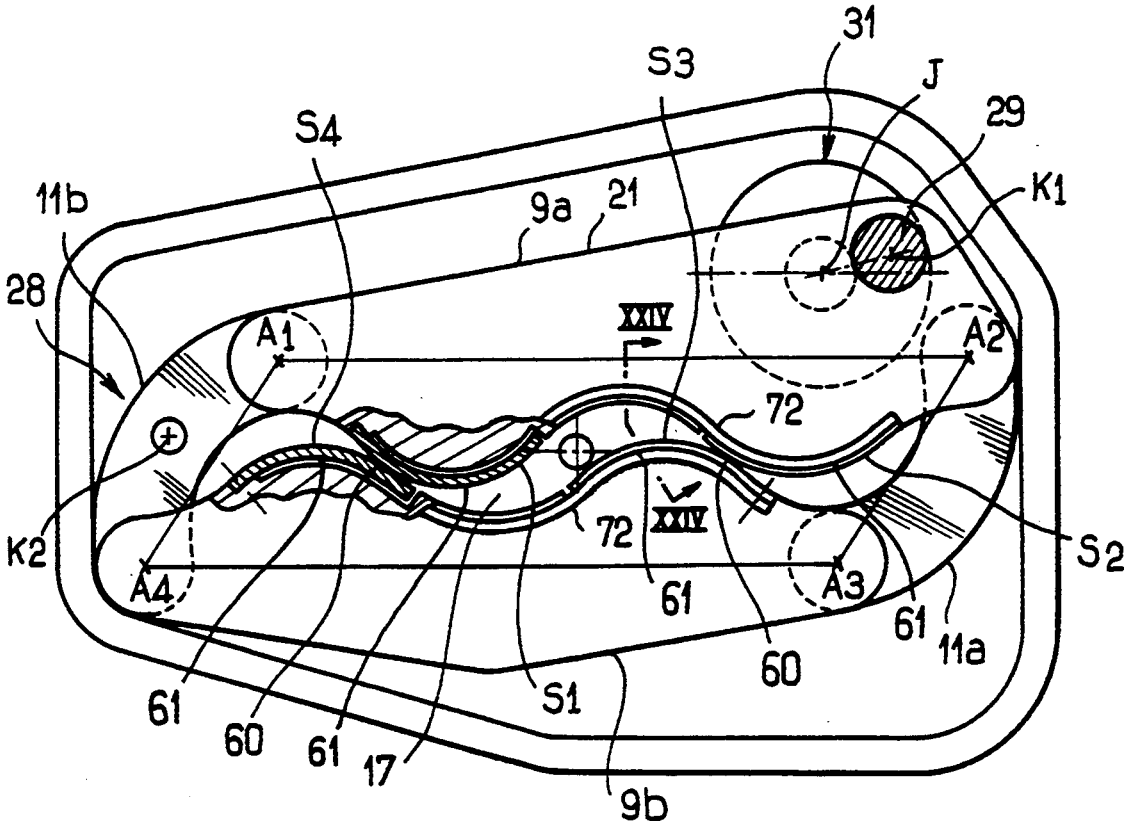
FIG. 21 is a view similar to FIG. 5, but relating to another embodiment.

In the diagrams of the example shown in FIGS. 17 to 19, the assembly formed by the four elements 9*a*, 9*b*, 11*a* and 11*b* is the same as in FIGS. 1 to 9, with two convex cylindrical walls S1, S2 and S3, S4 respectively on each of first elements 9*a* and 9*b*. However, the means of dynamic sealing between the convex cylindrical walls of the same pair S1 and S4, and S2 and S3 respectively, instead of consisting of a mere proximity, comprise, for each pair, a Z-shaped floating bar 48 each base of which ends in a slightly re-entrant fin 49. The said floating bar is an easy approximation to achieve as compared to a biconcave body which would have two opposing concave cylindrical faces marrying up the two convex cylindrical walls such as S2 and S3 to seal off one from the other. Each bar 48 is forced to center itself on corresponding Line L14 or L23 since the two areas of the bar located either side of this line are wider than the distance between the two cylindrical walls along this line.

Thus, each floating bar 48, which slides at the same time on both cylindrical walls of the same pair, such as S2 and S3, so that it seals off one from the other, is always automatically positioned in a suitable way to ensure such sealing, whatever the attitude of the four elements 9*a*, 9*b*, 11*a* and 11*b* in relation to each other.

As FIG. 19 shows, floating bars 48 have at each longitudinal end, in the extension of the bases of the Z, tongues 53 bent towards the inside of chamber 17 to press in a sealed manner against faces 3*a* and 3*b* of the housing.

The embodiment shown in FIGS. 17 to 19 also differs from that shown in FIGS. 1 to 9 in its means of co-ordination which comprise, in addition to crank 31 connected to the drive shaft (not shown) a second crank 51 which is connected to crank 31 by two pinions 52 mounted in series so that second crank 51 turns at the same speed and in the opposite direction to crank 31.

Crank 31 drives in rotation first co-ordination axis K1, which in this example is confused with articulation axis A2. The second crank 51 drives in rotation the second co-ordination axis K2 which, in this example, is confused with articulation axis A4 opposite axis A2.

Axes of co-ordination K1 and K2 are therefore symmetrical in relation to center W of parallelogram A1, A2, A3, A4 which coincides with the axis of hole 24 for the spark-plug. The assembly of the machine is symmetrical in relation to this center, including axes of rotation J1 and J2 of cranks 31 and 51.

In FIG. 17, the machine is shown in a maximum-volume position of chamber 17. The minimum-volume positions are achieved when axes K1 and K2 are on Line N intersecting axes J1 and J2.

In FIG. 18, the machine is shown close to such a minimum-volume position.

By choosing the appropriate distance between axes J1 and J2 of the two cranks 31 and 51 as well as the gyration radius of axes K1 and K2 around axes J1 and J2, we define the distance between axes K1 and K2 in each of the two minimum-volume positions of chamber 17, and it is thus possible, as in the previous embodiments, for these two volumes to be different.

During operation, centre W of parallelogram A1, A2, A3, A4 is stationary. Consequently, the movements of the four elements 9*a*, 9*b*, 11*a*, 11*b* are equivalent to to-and-fro movements of elements 9*a* and 9*b* in relation to each other, with a correlative pivoting movement of elements 11*a* and 11*b*, and a superimposed oscillating movement of the whole assembly around the geometrical axis passing through centre W.

Excellent equilibrium can be achieved for all the inertial forces generated by this combination of movements by providing a machine that comprises two elemental machines stacked one on top of the other (essentially as shown in FIG. 3) with an offset of 180° of angle of crank 31 between them.

In the example in FIGS. 17 to 19, as we have seen, sealing bars 48 are stationary in relation to Lines L14 and L23.

Figure 20:
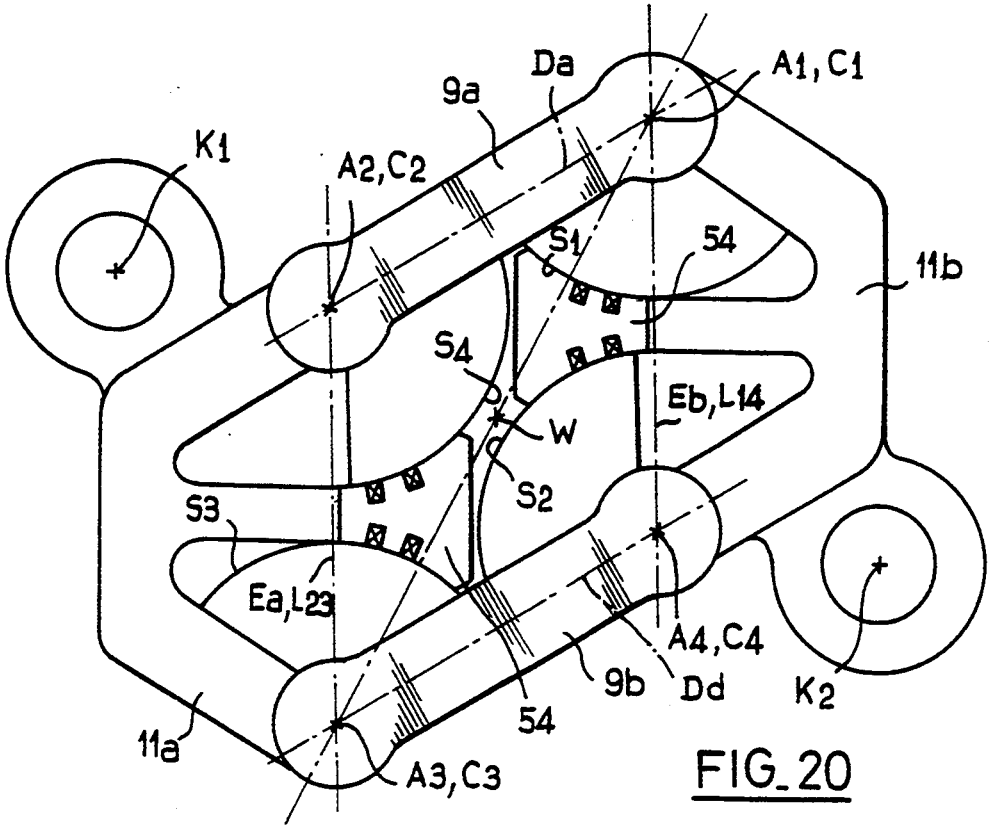
FIG. 20 is a schematic view of the four elements of a sixth embodiment of the invention.

The embodiment shown in FIG. 20 exploits this observation. The second elements are articulated to the first elements around the corresponding axes of convex cylindrical walls S1–S4. In other words, axes A1 and C1, A4 and C4 are indistinguishable by pairs. In these conditions, longitudinal axis Ea or Eb of each second element 11*a* or 11*b* is indistinguishable from Line L23 or L14 respectively. Each dynamic sealing body 54 is therefore stationary in relation to one of the second elements 11*a* and 11*b*. This has made it possible to create a rigid connection between each sealing body 54 and the respective body of second elements 11*a* and 11*b*. Each sealing body has a biconcave shape marrying up the two convex cylindrical walls between which it creates dynamic sealing.

This makes it possible to create between each sealing body 54 and the two cylindrical walls with which it co-operates, a high-quality seal, suitable for instance for diesel cycle operation.

Furthermore, in the example in FIG. 20, co-ordination axes K1 and K2 are each connected to one of the second elements 11*a* and 11*b* respectively, in symmetrical positions in relation to centre W of parallelogram A1, A2, A3, A4. Axes K1 and K2 are driven in rotation by two cranks such as 31 and 51 in FIGS. 17 and 18 which are symmetrical in relation to centre W and connected to each other to turn in opposite directions.

Making the machines according to the invention is particularly simple, since the main operating surfaces can all be made flat or cylindrical. Sealing is achieved under zero or low load and wear of the machine is therefore reduced. The speed of relative displacement at the sealing lines or surfaces is remarkably low as compared to the speed of rotation of the crank. Furthermore, a given speed of rotation of the crank makes it possible to achieve twice as many cycles per unit of time than a conventional piston and cylinder engine. It is therefore possible to envisage speeds of rotation double those of conventional engines, with consequently four times as many cycles per unit of time. At such cycle speeds, the combustion and explosion strokes are very brief and heat loss is particularly low. For a given power, the speed doubles and doubling the number of cycles per revolution of the crank in theory makes it possible to have a cubic capacity ("cc") four times smaller, which limits the surfaces from which heat escapes and consequently further limits heat loss.

It will also be noted that the movement of first and second elements 9*a*, 9*b*, 11*a*, 11*b* against faces 3*a* and 3*b* is a turning movement without a break point, which is particularly favourable for achieving perfect running in on these surfaces, making the surfaces in question particularly resistant to wear and exhibit particularly good sealing qualities by simple proximity. The large contact surface between elements 9*a* and 9*b* and faces 3*a* and 3*b* promotes cooling of elements 9*a* and 9*b*.

In the example shown in FIGS. 21 to 24, the cylindrical walls S1 to S4 are defined by shells 61 which, in each pair, are directly pushed against each other along a sealing line 60 forming one of the ends of chamber 17. Each shell has a free inner edge 62 always located inside chamber 17 and an outer edge 63 always located outside chamber 17. Outer edge 63 is adjacent to a fixing area 64 of shell 61. Area 64, always situated outside chamber 17, is fixed in a sealed manner to first element 9*a* or 9*b* to which it is associated. Each first element therefore has two shells 61, directed towards each other from their respective fixing area 64.

Starting from fixing area 64, shell 61, made of steel for example, floats by elastic bending. The fact that it presses against the other shell 61 of the same pair is due to elastic prestressing during assembly.

Behind each shell 61 is an intercalary space 66 which communicates with chamber 17 through a slot 67 adjacent to inner edge 62 of the shell. Thus, when chamber 17 is full of gas under pressure, this gas passes into intercalary space 66 to strengthen the mutual pressing of the two shells 61 of each pair. The back faces of shells 61 are permanently exposed along their entire length to the pressure of chamber 17. By contrast, their front faces, i.e. cylindrical walls S1 to S4, are not exposed to the pressure of chamber 17 except along a reduced and variable length. Thus, when chamber 17 has one or other of its two possible minimum volumes (FIG. 22), one of the cylindrical walls (S1) of each pair is exposed along practically its entire length to the pressure in chamber 17 whilst the other cylindrical wall (S4) is only exposed to the pressure along a short part of its length. Thus, the pressing force acting on this wall S4 compensates only partially for the pressing force acting on the front face of associated shell 61, which therefore presses hard against the other shell. The latter does not bend unduly since the pressing occurs close to its fixing area 64, and thus with a small bending torque.

By contrast in a situation not shown here, where the volume of the chamber is essentially at its maximum, the force produced by the pressure is more or less the same on both shells so they therefore balance each other out with a very slight deformation as compared to the neutral state. The deformation of the shells is thus reduced in all cases.

Figure 24:
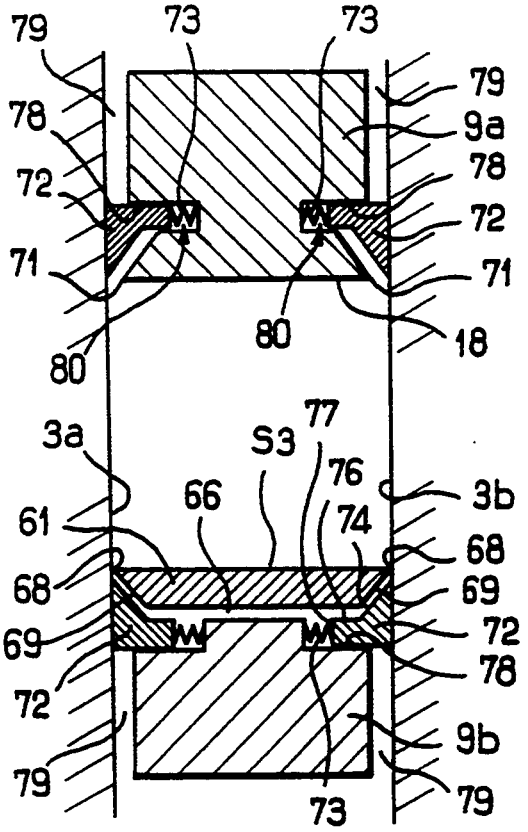
FIG. 24 is a sectional view along XXIV—XXIV of FIG. 21.

As shown in FIG. 24, each shell 61 has along each face 3*a* or 3*b* a side edge formed by a ridge 68 defined by the corresponding cylindrical wall, such as S3, and a chamfered wall 69 forming an angle of about 45° with cylindrical wall S3. When shell 61 undergoes bending movements, inner edge 62 and ridges 68, as well as the cylindrical wall that they surround, move in relation to the body of the first corresponding element. Ridge 68 is in movable proximity and essentially sealed with adjacent face 3*a* or 3*b*. Thus, the gas in intercalary space 66 cannot easily escape in the way shown by arrow 70 in FIG. 22.

As FIG. 24 shows, each connecting wall 18 is integral with the body of the element (9*a*) that supports it. It is also terminated by two side ridges 71 but these ridges 71 are at a certain distance from faces 3*a* and 3*b* to avoid any friction.

On the side opposite each ridge 68, intercalary space 66 is limited by a sealing segment 72 (FIG. 24) which is made to press in a movable and sealing manner against adjacent face 3*a* or 3*b* by a prestressed spring 73. Each segment 72 has a chamfered face 74 which is parallel to chamfered face 69 of shell 61 although at a certain distance from the latter. This chamfered face 74, as well as a side face 76 and a back face 77 of each segment, undergo the pressure existing in intercalary space 66, which thus helps to press segment 72 against the opposite face 3*a* or 3*b* and against a pressing face 78 of the body of the corresponding element, 9*b* in FIG. 24. This double sealed pressing prevents the gas under pressure from escaping through an area 79 located between the body of first element 9*a* or 9*b* and each opposite face 3*a* or 3*b*.

Figure 23:
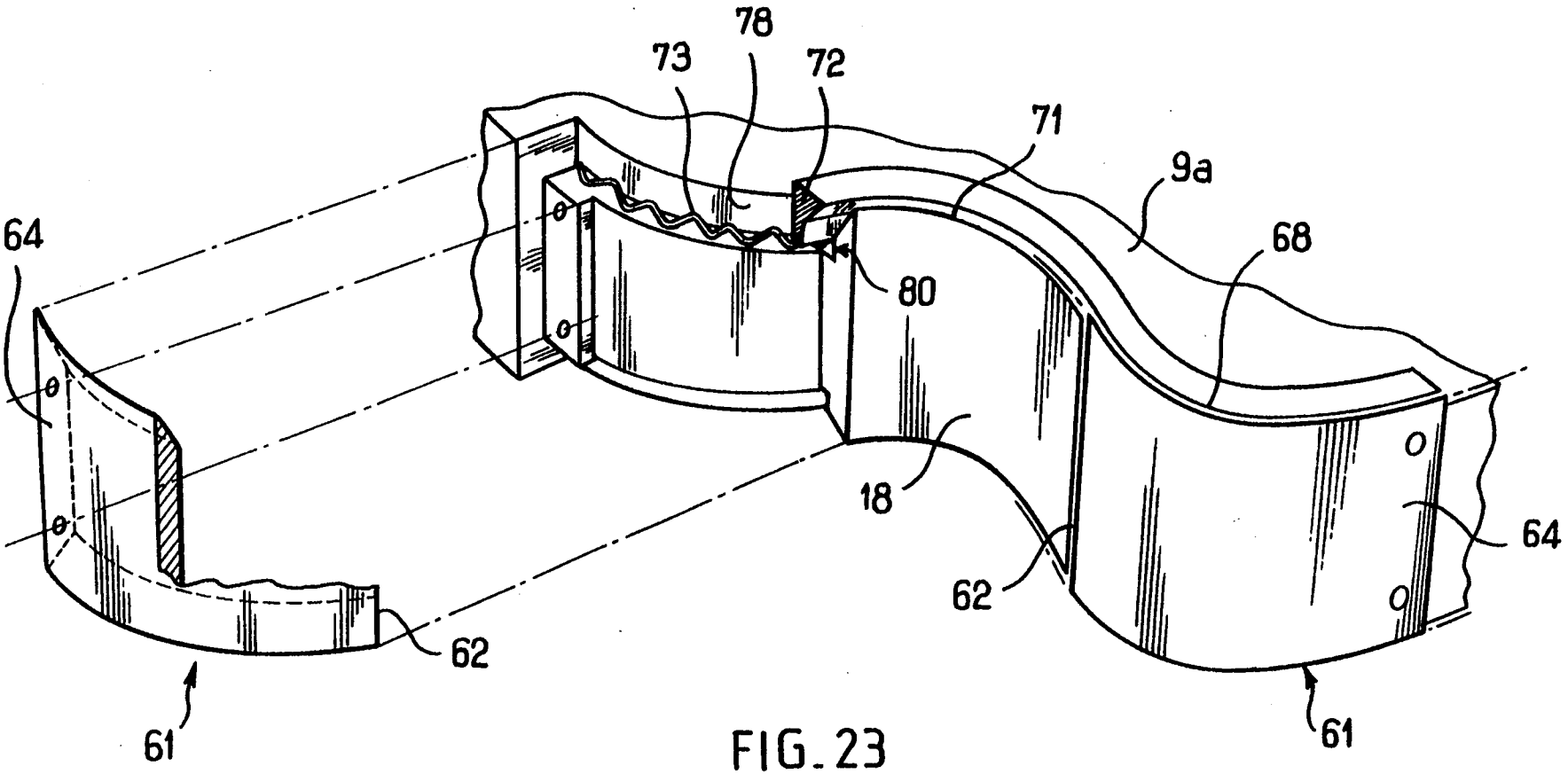
FIG. 23 is an exploded perspective view of one of the first elements in FIG. 21, and some of its parts, with sectional and cutaway sections.

As FIG. 23 also shows, each segment 72 and associated spring 73 extend continuously between the two fixing areas 64 of the two shells 61 associated with corresponding element 9*a* or 9*b*. Spring 73 may be in the form of a corrugated elastic rod. Behind connecting wall 18, element 9*a* or 9*b* has opposite each face 3*a* or 3*b* a shaped groove 80 housing the corresponding part of the length of segment 72 and spring 73. This groove 80 communicates with chamber 17 through slots 67 between which it extends and also through the gap existing between ridges 71 (FIG. 24) and faces 3*a* and 3*b*. Thus, in this area too, the pressure pushes segments 72 against faces 3*a* and 3*b* and against pressing face 78 of elements 9*a* and 9*b*. Between chamber 17 and areas 79 there is thus continuity of seal along the entire length of first elements 9*a* and 9*b* which is apt to be exposed to pressure.

In practice, in the vicinity of the fixing area 64 of each shell 61, priority would be given to encouraging reliability and reducing friction rather than achieving a perfect seal since the escape paths leading to this area are very complex and narrow, like labyrinths, and in any case allow only a very small flow through. It is moreover possible to increase this labyrinth effect further by roughening the faces defining intercalary spaces 66.

The embodiment which has just been described has the advantage of achieving controlled sealing conditions between cylindrical walls S1 to S4 in a manner largely independent of the state of wear of the engine and precision of machining of the component parts. Furthermore, shells 61 dampen the vibrations of the first elements in relation to each other and prevent these vibrations from producing knocking between cylindrical surfaces S1 to S4. This greatly prolongs the operating life of these surfaces and helps to keep, over time, the sealing quality along lines 60 at a high standard.

Figure 22:
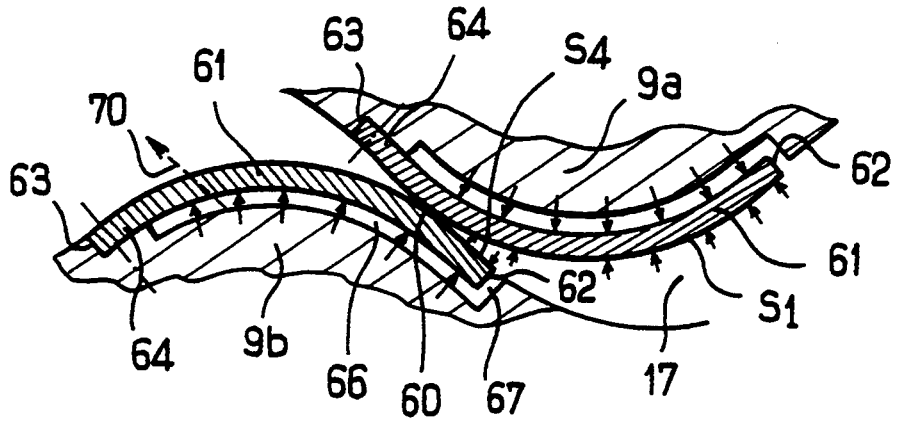
FIG. 22 is a large-scale detail of FIG. 21.
Figure 26:
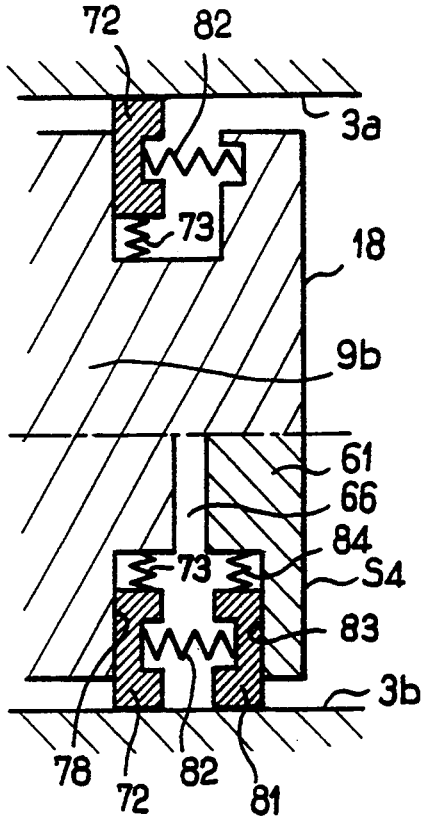
FIG. 26 is a sectional view of the first element along lines XXVIa—XXVIa at the top of the Figure and XXVIb—XXVIb at the bottom of the Figure.
Figure 25:
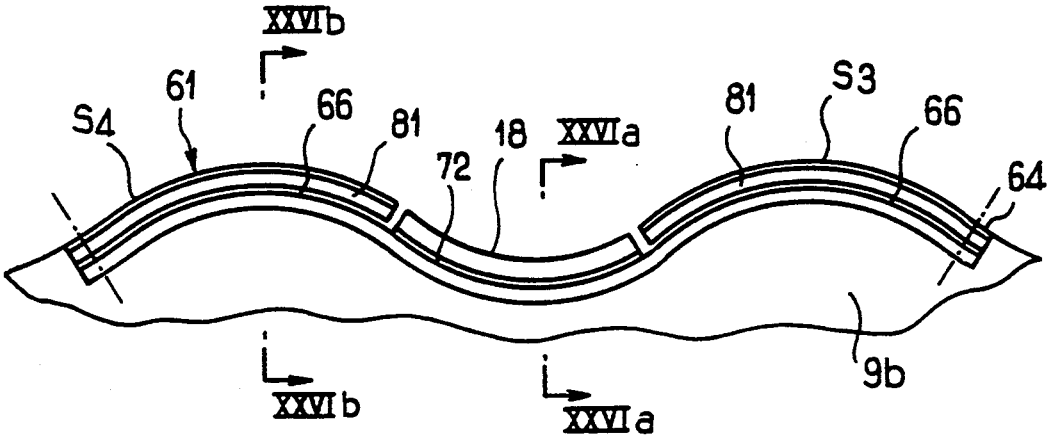
FIG. 25 is a partial view of another embodiment of the first element.

In the embodiment shown in FIG. 25, segments 81 have been added along the side edges of shells 61 to further reduce the possibility of leakage along a path such as that illustrated by arrow 70 in FIG. 22. Segment 72 runs along the entire length of each first element 9*a* or 9*b*, as described with reference to FIGS. 21 to 24. Thus, as shown at the bottom of FIG. 26, along each face 3*a* or 3*b*, intercalary space 66 is defined between the two segments 72 and 81. The pressure of the gases, assisted by a pre-stressed distancing spring 82, tends to keep the two segments apart and push them in a sealed way against face 78 of the body of first element 9*b* and against a sealing face 83 at the back of shell 61 respectively.

Furthermore, the pressure, assisted by a prestressed spring 84 similar to spring 73, permanently pushes segment 81 against the corresponding opposite face, 3*b* in FIG. 26. Along connecting wall 18 (top of FIG. 26), there is only one segment (72). It is pushed by the pressure of the gases and prestressed by springs 73 and 82 as described above.

Of course, the invention is in no way restricted to the examples described and illustrated.

In the example shown in FIG. 1, axis K1 and/or axis K2 could be made to coincide with one and/or other of articulation axes A1–A4.

With reference to the top of FIG. 3, distribution ports 19 and 21 could be made through face 3*b*, for example in a fixed position, and pivoting turret 8 could be replaced by a non-rotating plate having the sole function of pressing against elements 9*a* and 9*b* under the action of the pressure in back-pressure space 26.

In the embodiment shown in FIGS. 14 and 15, groove 42 and ring 43 could be located in face 3*b* in order to make ports 19 and 21 through face 3*a* more easily, particularly if the inlet port is required to be a cutaway section such as that shown in FIG. 10, which would then be made in face 3*a* only.

In the embodiment shown in FIGS. 17 to 19, their is no necessity to combine floating bars 48 on the one hand and the means of co-ordination in the form of two crankshafts 31 and 51 on the other: these two improvements could be used independently of each other.

Similarly, in the example shown in FIG. 20, the means of co-ordination could be different.

The invention could be used to create a compressor or a pump or even an expansion machine operating at two cycles per revolution, or even a two-stroke engine operating at two cycles per revolution. In these various cases, arrangements would generally be made for the two minimum-volume positions to correspond to identical volumes, so that the two cycles of each revolution of the crank would be identical.

I claim:

1. A positive-displacement machine comprising, between two flat, parallel faces facing one another (3*a*, 3*b*), two first opposing elements (9*a*, 9*b*) articulated to two second opposing elements (11*a*, 11*b*) around four articulation axes (A1–A4) perpendicular to the said faces (3*a*, 3*b*) and arranged at the four apexes of a parallelogram, each side (Da, Db, Ea, Eb) of which constitutes the longitudinal axis of one of the respective first and second elements, the elements supporting four convex cylindrical walls (S1–S4) which between them define a variable-volume chamber (17), the longitudinal axis (Da, Db) of each first element (9a, 9b) being intersected by the axes (C1, C2; C3, C4) of two respective convex cylindrical walls (S1, S2; S3, S4), two lines (L14, L23) running in the same direction as the axes (Ea, Eb) of said second elements (11a, 11b) each being intersected by the axes (C1, C4; C2, C3) of two respective ones of said convex cylindrical walls (S1, S4; S2, S3), the machine also comprising means of co-ordination (28, 31) connected to two of the elements (9a, 11b) along two co-ordination axes (K1, K2), the means of co-ordination comprising a crank (31) type system connected to a drive shaft and one (9a) of these two elements to make the parallelogram oscillate between said flat faces (3a, 3b) and at the same time cause its angles at the apex and consequently the volume of said chamber (17) to vary, distribution ports (19, 21) being located on one at least of said opposing flat faces (3a) to cause said chamber (17) to communicate selectively with an inlet (22) and an exhaust (23) depending on the angular position of said crank (31), characterised in that each first element (9a, 9b) rigidly supports the two convex cylindrical walls whose axes (C1–C4) intersect the longitudinal axis (Da, Db) of the said first element, in that each convex cylindrical wall forms with the convex cylindrical wall whose axis intersects the same line (L14, L23) a pair (S1, S4; S2, S3) of cylindrical walls belonging to different ones of said first elements (9a, 9b), in that each first element has closure means extending between its two convex cylindrical walls, and in that the machine comprises means of dynamic sealing between the convex cylindrical walls (S1, S4; S2, S3) of a same pair.

2. Machine according to claim 1, characterised in that the means of dynamic sealing comprise a proximity relation between the cylindrical walls of a same pair.

3. Machine according to claim 1, characterised in that the means of dynamic sealing comprise a floating body (48) mounted between the cylindrical walls (S1, S4; S2, S3) of a same pair.

4. Machine according to claim 3, characterised in that said floating body (48) is a Z-shaped floating bar.

5. Machine according to claim 1, characterised in that the means of dynamic sealing comprise, for each second element, an intermediate body (54) with two faces that are each in sealed contact with one of the cylindrical walls (S1, S4; S2, S3) of a same pair.

6. Machine according to claim 1, characterised in that the closure means present towards the chamber a concave-shaped face (18) which is essentially complementary to that of said cylindrical walls (S1, S2, S3, S4).

7. Machine according to claim 1, characterised in that the axes (C1–C4) of said convex cylindrical walls (S1–S4) coincide with the articulation axes (A1–A4) between the elements.

8. Machine according to claim 7, characterised in that the means of dynamic sealing (54) are supported by the second elements (11a, 11b).

9. Machine according to claim 1, characterised in that the axes (C1–C4) of said convex cylindrical walls (S1–S4) are, on each longitudinal axis of first element (9a, 9b), located between the two articulation axes (A1, A2; A3, A4) intersecting the said longitudinal axis (Da, Db).

10. Machine according to claim 1, characterised in that at least part of said distribution ports (19, 21) have an adjustable position in relation to a framework of the machine.

11. Machine according to claim 10, characterised in that said ports (19, 21) are made through a turret (8) which is adjustable by rotation and whose outer periphery surrounds said chamber (17) in all the angular positions of said crank (31).

12. Machine according to claim 1, characterised by means to cause the chamber to communicate with a back face of a plate (8) whose front face constitutes at least a part (3c) of one (3a) of the opposing faces, this plate having an independence in relation to the framework which enables said plate to press against said first elements (9a, 9b).

13. Machine according to claim 1, characterised in that one of the opposing faces, supported by a housing wall of the machine, has an annular groove (42) partially filled by a split ring (43), which is exposed to receive from the gases pressing forces directed towards said first elements (9a, 9b) and radially towards an outer peripheral edge (42b) of said groove (42), and which is capable of pressing in a sealed manner against the elements and against the said outer peripheral edge under the action of the said pressing forces.

14. Machine according to claim 1, characterised in that at least one of said cylindrical walls (S1–S4) is defined by a shell (61) which is elastically stressed towards the other cylindrical wall of the same pair, and in that a space (66) behind said shell (61) communicates with said chamber (17) so that the shell is further stressed towards the other cylindrical wall of the same pair by the pressure of the gases in the chamber.

15. Machine according to claim 14, characterised in that said shell (61) is fixed in an essentially sealed manner to one of said first elements (9a, 9b) in an outer area (64) which is always located outside said chamber (17) and in that an inner edge (62) of said shell (61), which is always located inside said chamber (17), as well as two side edges (68) of the shell, have freedom of movement by bending of the shell.

16. Machine according to claim 14, characterised in that each first element (9a, 9b) has, facing each opposing face (3a, 3b), sealing means (72, 81) which are placed under pressure by the gases occupying said space (66) behind said shell (61).

17. Machine according to claim 16, characterised in that the sealing means comprise, facing each opposing face, a sealing organ (72) extending the entire length of the chamber between two opposing fixing areas (64) belonging to two shells (61) defining two cylindrical walls (S1, S2; S3, S4) of a same first element (9a, 9b).

18. Machine according to claim 16, characterised in that the sealing means comprise a sealing organ (81) running along each side edge of each shell (61).

19. Machine according to claim 14, characterised in that side edges (68) of said shell (61) are at least approximately sealed with said opposing faces (3a, 3b).

20. Machine according to claim 14, characterised in that the two cylindrical walls (S1, S4; S2, S3) of at least one of the pairs comprise two similar shells (61).

21. Machine according to claim 1, characterised in that the closure means between the two convex cylindrical walls of each first element (9a, 9b) present towards the other first element a corrugated wall defining at least one projection (S5, S6) between the two cylindrical walls.

22. Machine according to claim 21, characterised in that the projection is a third convex cylindrical wall (S5, S6) resembling the other two.

23. Machine according to claim 1, operating as a four-stroke thermal engine, characterised in that it comprises means to initiate combustion (25) positioned to correspond with said chamber (17) at least when the latter is in a first minimum-volume position.

24. Machine according to claim 23, characterised in that said co-ordination axes (K1, K2) are located outside said parallelogram (A1, A2, A3, A4).

25. Machine according to claim 23, characterised in that the means of co-ordination are connected to the elements so that the angular distance (TD) between two crank positions corresponding to the first minimum-volume position and a first maximum-volume position respectively, is less than 90°.

26. Machine according to claim 23, characterised in that the means of co-ordination are designed and connected to the elements so that the volume of said chamber (17) is greater in the first minimum-volume position than in a second minimum-volume position, created at the end of an exhaust stroke during which said chamber (17) communicates with an exhaust port (21) forming part of said distribution ports (19, 21).

27. Machine according to claim 26, characterised in that in the second minimum-volume position, the volume of said chamber (17) is essentially zero.

28. Machine according to claim 22, characterised in that the distribution ports comprise an inlet port (19) consisting in a cutaway section made in at least one of said flat faces (3*a*, 3*b*) in order to cause chamber (17) to communicate selectively with a supply space (41) located along at least one part of the outer periphery of elements (9*a*, 9*b*, 11*a*, 11*b*), in a housing (2) surrounding the elements, this space being connected to means of combustion gas supply.

29. Machine according to claim 28, characterised in that said supply space (41) is delimited between two barriers (56, 57) which are spaced apart in the peripheral direction of the housing and create, at least during an inlet stroke, a quasi seal between the inner profile of the housing and the elements, in an area of the periphery of the housing which is selected so that supply space (41) reduces in volume when it communicates with said chamber (17).

30. Machine according to claim 29, characterised in that the housing has an inner profile having certain areas (58, 59) which correspond essentially to the envelope of the positions of two areas of the elements between which areas said supply space (41) is delimited, the two barriers being created by proximity between the two areas of the elements and the inner profile of the housing.

31. Machine according to claim 29, characterised in that the two areas of the elements are integral with a same said element (9*b*), and in that the barriers have at least one vane (56, 57) integral with this element or the housing, and a notch in the housing or on the said element respectively, the said notch having a profile corresponding to the envelope of the end positions of the vane in relation to the notch.

32. Machine according to claim 28, characterised in that the barriers separate the supply space from an inlet space (40) with which said supply means (39) communicate.

33. Machine according to claim 30, characterised in that the supply means are means of supplying an air/petrol/oil mixture.

34. Machine according to claim 24, characterised in that said crank (31) is arranged so that in the first minimum-volume position the lever arm of the crank is positioned transversely to the direction of the force of expansion (P) of the gas acting on that one (9*a*) of the two elements which is connected to said crank (31), and said lever arm moves in the direction (F) of the said force (P).

35. Machine according to claim 1, characterised in that the means of co-ordination (28) can be adjusted to change the volume of the chamber in one of the minimum-volume positions, and thus adjust a compression ratio of the machine.

36. Machine according to claim 1, characterised in that the means of co-ordination comprise, apart from the system of a crank (31) type connected to one (9*a*) of the two said elements along a first one of said co-ordination axes, a pivoting connection (28) between the other (11*b*) of the two elements and a machine framework around a second one of said co-ordination axes (K2).

37. Machine according to claim 36, characterised in that the two elements to which the means of co-ordination are connected are a first (9*a*) and one of the second elements (11*b*), and in that the distance between the second co-ordination axis (K2) and articulation axis (A1) between the two elements (9*a*, 11*b*) is greater than the radius of the crank.

38. Machine according to claim 37, characterised in that the distance between said second co-ordination axis (K2) and axis (J) of said crank (31) is slightly shorter than the sum of the distances separating the articulation axis (A1) of the two elements from the second co-ordination axis (K2) on the one hand and from the axis (J) of the crank on the other hand.

39. Machine according to claim 38, characterised in that in the first minimum-volume position, articulation axis (A1) between the two elements (9*a*, 11*b*) is located between the two co-ordination axes (K1, K2).

40. Machine according to claim 36, characterised by comprising means for adjusting the distance between the second co-ordination axis (K2) and the crank pivoting axis (J) in relation to the framework.

41. Machine according to claim 1, characterised in that the means of co-ordination comprise two crank type systems (31, 51), each connected to one of the said two elements.

42. Machine according to claim 41, characterised in that the said two elements are two opposing elements (11*a*, 11*b*).

43. Machine according to claim 41, characterised in that the two crank type systems are essentially identical (31, 51), connected together in order to turn at the same speed in opposite directions, and, like said co-ordination axes (K1, K2), are symmetrical in relation to centre (W) of the parallelogram.

* * * * *